US008651195B2

(12) United States Patent
Yoshida

(10) Patent No.: US 8,651,195 B2
(45) **Date of Patent: *Feb. 18, 2014**

(54) JETTING APPARATUS FOR FIRE EXTINGUISHING GAS AND DISASTER WARNING SYSTEM

(76) Inventor: Hideo Yoshida, Tokorozawa (JP)

( * ) Notice: Subject to any disclaimer, the term of this patent is extended or adjusted under 35 U.S.C. 154(b) by 807 days.

This patent is subject to a terminal disclaimer.

(21) Appl. No.: 12/712,495

(22) Filed: Feb. 25, 2010

(65) Prior Publication Data

US 2010/0147540 A1 Jun. 17, 2010

Related U.S. Application Data

(63) Continuation-in-part of application No. 12/225,826, filed on Sep. 29, 2008.

(30) Foreign Application Priority Data

May 18, 2006 (JP) ..... 2006-138589
Apr. 11, 2007 (JP) ..... 2007-103491

(51) Int. Cl.
*G08B 21/00* (2006.01)

(52) U.S. Cl.
USPC ..... 169/72; 169/30; 169/51; 169/56; 169/60; 169/76; 169/89; 222/23; 222/83; 239/71; 239/72; 239/309

(58) Field of Classification Search
USPC ..... 169/51, 30, 71, 72, 76, 81, 83, 89, 88, 169/56, 60; 222/5, 80, 83, 23, 39; 137/68.29, 68.3; 239/71, 72, 309; 116/3, 4, 202
See application file for complete search history.

(56) References Cited

U.S. PATENT DOCUMENTS 4,003,048 A * 1/1977 Weise ..... 340/568.4
4,236,148 A * 11/1980 Gurvis ..... 340/568.8
4,418,336 A * 11/1983 Taylor ..... 340/571
5,704,428 A * 1/1998 Asano ..... 169/74
5,952,919 A * 9/1999 Merrill ..... 340/539.18
6,138,768 A * 10/2000 Fujiki ..... 169/30
6,641,286 B2 * 11/2003 Hincher, Sr. ..... 362/253

* cited by examiner

*Primary Examiner* — Steven J Ganey
(74) *Attorney, Agent, or Firm* — Jordan and Hamburg LLP

(57) ABSTRACT

A jetting apparatus for fire extinguishing gas has a gas cylinder which is charged with pressurized fire extinguishing gas therein and onto an opening of which a sealing plate opening is attached. The jetting apparatus has a two part case that can receive the gas cylinder. The jetting apparatus has a seal breaking member that has a neb capable of breaking the sealing plate. The jetting apparatus has a seal breaking member holder that is attached the seal breaking member. The jetting apparatus has a mouth part of the gas cylinder that is attached detachably, and a cylinder holder that has a through hole movably housing the seal breaking member therein. The jetting apparatus has a seal breaking member holder and a cylinder holder that can relatively approach each other. The jetting apparatus has a jetting port that is provided on the outside of the apparatus and can communicate with the through hole. The jetting apparatus has a control valve that can intercept passages communicating the through hole with the jetting port and is provided in the passages.

14 Claims, 17 Drawing Sheets

JETTING APPARATUS FOR FIRE EXTINGUISHING GAS AND DISASTER WARNING SYSTEM

STATEMENT OF RELATED APPLICATIONS

The present application is a continuation-in-part of copending U.S. application Ser. No. 12/225,826 filed Sep. 29, 2008, the disclosure of which is incorporated herein by reference.

BACKGROUND OF THE INVENTION

The present invention relates to a jetting apparatus for fire extinguishing gas and a disaster warning system. This invention is suitable for a handy fire extinguisher, for example, in a house, an office or a vehicle, easily punctures a small gas cylinder charged therein, temporarily prevents gushed fire extinguishing gas from outflowing and being wasted by a valve, and attempts to use the fire extinguishing gas effectively and extinguish a fire effectively. Further, this invention jets the fire extinguishing gas to a fire source surely and properly in fire fighting so that this invention can realize that a fire is extinguished effectively, surely and early; and informs a person where a fire extinguisher is when a fire or earthquake occurs so that a person can use the fire extinguisher quickly and extinguish a fire early.

For example, popular fire extinguishers, which are set in houses or offices, mostly have difficulty in use because the fire extinguishers are large and heavy, require force to handle.

Therefore, many kinds of small, light, handy, fire extinguishers have been invented to solve the difficulty. Methods of piercing a sealing plate on a gas cylinder classify the handy fire extinguishers into three kinds of fire extinguishers, that is, fire extinguishers that a tubular body or a cover is turned, fire extinguishers that an operation block is pushed down, and fire extinguishers that a head or a bottom is knocked.

The fire extinguishers that a tubular body or a cover is turned has a tubular body that receives a gas cylinder, an upper cover body that is screwed into an upper end of the tubular body, a cylinder fitting body that can be screwed into a threaded mouth of the gas cylinder, and a nozzle body that attaches a piercing pipe thereto. Regarding the described fire extinguishers, a center tubular part of the cylinder fitting body is inserted into an opening of an upper part of the tubular body; the nozzle body is inserted inside of the center tubular part; an upper part of the nozzle body is inserted into an opening of the upper cover body; in fire fighting, the upper cover body or the tubular body is turned in axial rotation, the piercing pipe is moved toward the gas cylinder, and cooling gas gushes from a jetting hole of the nozzle body (see Japanese unexamined patent publication No. H09-103512).

The fire extinguishers that an operation block is pushed down has an operation face and a tab of a safety block on an upper part of a case capable of receiving a gas cylinder; a shaft body with a piercing pipe that is attached in the case to slide upward and downward; and a retainer that is put on a retaining slot for the shaft body. Regarding the described fire extinguishers, in fire fighting, the safety block is pulled down through the tab, the operation face is pushed to move the retainer inside, rims of the retaining slot and an opening are disengaged, the shaft body is pushed down by resilience of a spring, the piercing pipe is moved toward the gas cylinder to pierce a sealing plate, gushed gas is moved into the shaft body, and then the gushed gas is jetted from a jetting hole (see Japanese unexamined patent publication No. 2000-189534).

The fire extinguishers that a head or a bottom is knocked has a gas cylinder that is received in a pipe body covered with a cover; a dish-form nozzle that is attached on a lower end of the pipe body; a pusher guiding body that is attached on an upper end of the pipe body; and a pusher with a piercing pipe that is attached in the pusher guiding body to slide. Regarding the fire extinguishers, a safety plate is normally inserted into the pusher to prevent the pusher from moving; on the other hand, a cylinder receiver is attached in the pusher guiding body and is screwed a threaded mouth of the gas cylinder. Further, in fire fighting, the safety plate attached in the pusher is pulled out of the pusher, the out side of the pusher is knocked by a hand to be pushed in, the piercing pipe is moved toward the gas cylinder to pierce a sealing plate, gashed gas moves from the inside of the pipe body to the inside of the shaft body, and then the gushed gas is jetted from a jetting hole (see Japanese Patent publication No. 2890097).

However, there are problems in the fire extinguishers classified into three kinds of fire extinguishers.

With respect to the fire extinguishers that a tubular body or a cover is turned, there is a problem that the tubular body or the cover should be turned so many times that the piercing pipe can pierce a sealing plate because the piercing pipe is slightly moved in spite of turning the tubular body or the cover many times. Therefore, it takes time to pierce the sealing plate and it is difficult to extinguish a fire quickly.

With respect to the fire extinguishers that an operation block is pushed down, there is a problem in that operation for fire fighting is complicated because the operation requires to push down a safety block and push an operation face.

Moreover, with respect to the fire extinguishers that a head or a bottom is knocked, operation for fire fighting is comparatively easy and the fire extinguishers can extinguish a fire quickly, however, there is a problem in that a safety plate is pulled out prankishly or accidentally to pierce a sealing plate because the safety plate is shown outside.

In addition, all of three kinds of fire extinguishers, the jetting hole is faced to a fire source when a sealing plate is pierced, however, as a user concentrates on piercing the sealing plate in fire fighting, and has difficulty in facing the jetting hole to a fire source property, as a result, early jetted gas is wasted, or cannot be used efficiently. Therefore, as a fire cannot be extinguished early and may be substantially extinguished by gas not wasted, there is a problem in that a fire cannot be extinguished successfully considering to the amount of charged gas and the gas cannot be used efficiently.

Then, when a fire extinguisher is used in a fire breaking, a user is too hurry and upset to know or remember where a fire extinguisher is, and the fire may not be extinguished early.

The mentioned troubles are particularly seen when the fire is extinguished at night or in power failure.

In order to solving the troubles, there are fire extinguishers that has a power supply part, a switch and an alarm transmitting part, and an alarm is raised when the switch is turned on (see Japanese unexamined patent publication No. 2004-351047).

However, the fire extinguishers may not help persons to find the fire extinguishers because the switch is provided on a safety plug and persons can find the fire extinguishers when the safety plug is pulled out and the switch is turned on to inform the persons of the presence of the fire extinguishers. Further, in case no persons know where the fire extinguishers are, the persons cannot use the fire extinguishers, and there is a problem in that the fire extinguishers cannot be used quickly because the alarm is raised by a person, and it takes time to raise an alarm.

SUMMARY OF THE INVENTION

It is an object of the present invention to solve the mentioned problem and to provide a jetting apparatus for fire extinguishing gas that is suitable for a handy fire extinguisher, for example, in a house, an office or a vehicle, easily pierces a sealing plate of a small gas cylinder charged therein, temporarily prevents gushed fire extinguishing gas from outflowing and being wasted by a valve, and attempts to use the fire extinguishing gas effectively and extinguish a fire effectively. Further, this invention jets the fire extinguishing gas to a fire source surely and properly in fire fighting so that this invention can realize that a fire is extinguished effectively, surely and early; and informs persons where the fire extinguisher is so that a person can use the fire extinguisher quickly and extinguish a fire early when a fire occurs.

This invention has a gas cylinder that is charged with pressurized fire extinguishing gas and attaches a sealing plate on an opening thereof; cases (a top case and a bottom case) that can receive the gas cylinder; a piercing member that has a point capable of piercing the sealing plate; a piercing member holder that attaches the piercing member therein; and a mouth part of the gas cylinder that is provided detachably. Moreover, this invention has a cylinder holder that has a through hole that movably houses the piercing member therein; the piercing member holder or the cylinder holder that can approach the cylinder holder or the piercing member holder; a jetting port provided outside of the jetting apparatus for fire extinguishing gas and the through hole that can communicate each other. Regarding the jetting apparatus for fire extinguishing gas as described above, a control valve that can intercept a passage communicating the through hole with the jetting port is provided in the passage. Thus, this invention prevents fire extinguishing gas, which is gushed after piercing the sealing plate, from being released and being wasted, can accurately jet the fire extinguishing gas to a fire source, and attempts to use the fire extinguishing gas effectively and extinguish a fire early and effectively.

According to the present invention, the control valve can usually close so that the control valve can prevent the fire extinguishing gas, which gushes after the sealing plate is pierced, from being released and being wasted. According to the present invention, the control valve can open on demand, this invention can accurately jet the fire extinguishing gas, which gushes after the sealing plate is pierced, to a fire source, and can realize that the fire extinguishing gas is used efficiently and a fire is extinguished early and effectively.

In a specific aspect of the present invention, a combination jetting apparatus for fire extinguishing gas and disaster warning system comprises, for the jetting apparatus, a gas cylinder charged with pressurized fire extinguishing gas to which is attached a sealing plate on an opening thereof, a seal breaking member having a neb configured to break the sealing plate, a mouth part for the gas cylinder detachably attached to the gas cylinder, a cylinder holder formed therein with a guide hole, which removably receives the seal breaking member therein, a seal breaking holder mounted with the seal breaking member and biased to an opposite side from the gas cylinder when in ready-to-use state, a passage communicable with the guide hole and a conducting hole through which the fire extinguishing gas sprays through after the seal is broken. The disaster warning system part of the combination includes an accident alarm for warning persons after a signal is transmitted by a fire detection signal or an earthquake detection signal of predetermined vibration. An alarm apparatus is part of the disaster warning system, which alarm apparatus receives the alarm transmitted from the accident alarm and outputs a notification signal with sound, voice, or light. Thus, attachment of a fire detector and a vibration detector may be omitted.

The accident alarm and the alarm apparatus are simple in structure, inexpensive, small, and light so that they are suitable to be attached to the small jetting apparatus. The jetting apparatus with the alarm apparatus is arranged logically in a manner such that these components can be located apart from the accident alarm. In addition, a notification signal, such as sound, voice, or light, notifies location of the jetting apparatus reliably and quickly so that the jetting apparatus can be used quickly.

According to the present invention, the passage is formed in the piercing member holder, and the control valve is disposed in a middle part of the passage so that the control valve can open or close to surely control release or interception of the fire extinguishing gas that moves in the passage.

According to the present invention, a housing is disposed in the top case, a control lever is turnably connected over an upper part of the housing, and the control lever is disposed on a surface of the top case. Moreover, the piercing member holder is fixed in the housing, a pushrod that can engage with the control valve is provided in an upper part of the piercing member holder to move vertically, the control lever is disposed to engage with the pushrod, and the control valve can surely open or close through the concrete structure for control.

In another specific aspect of the present invention, a fire detector and/or vibration detector and the accident alarm are installed indoors. The detection of a fire condition or earthquake condition is transmitted by signal from the fire detector or the vibration detector and inputted to the accident alarm, and further, the alarm apparatus is configured to receive a disaster warning electric wave signal transmitted from the accident alarm. The fire detector or the vibration detector, the accident alarm, and the alarm apparatus can be arranged apart from one another. Thus, an occurrence of a disaster is detected by the appropriate detector and the disaster information is transmitted to the accident alarm, and then to the alarm apparatus. In addition, communication between the accident alarm and the alarm apparatus is wireless so that the jetting apparatus is can be installed indoors at a desired position.

In a still more specific aspect of the present invention, the alarm apparatus comprises a receiver configured to receive an alarm signal from the accident alarm and a microphone configured to collect the alarm signal from the receiver, and a speaker or a voice guide recorder configured to output the notification signal through sound or voice, or through an alarm lamp, thereby transmitting the alarm signal to people by a variety of means.

According to the present invention, the piercing member holder is disposed in an upper part of the housing and the cylinder holder is disposed in a lower part of the housing, the cylinder holder can approach and be apart from the piercing member holder. Thus, the present invention can realize that the cylinder holder moves upward and the piercing member pierces the sealing plate when the sealing plate is pierced; and the fire extinguishing gas is stored after piercing the sealing plate.

According to the present invention, a tubular piercing member is disposed at a lower end part of a passage formed in the piercing member holder. The through hole can store the fire extinguishing gas gushed from the gas cylinder after the sealing plate is pierced, and the fire extinguishing gas that is stored in the through hole can be jetted from the jetting port when the control valve opens.

According to the present invention, after the sealing plate is pierced, the cylinder holder is provided to move upward, and the piercing member can be apart from the sealing plate. Thus, the present invention helps the fire extinguishing gas to gush from the gas cylinder, attempts to increase the capacity of the through hole, and can increase the quantity of stored fire extinguishing gas.

The sensing of heat or smoke by the fire detector or the sensing of earthquake-intensity vibration by the vibration detector is transmitted by signal to the accident alarm. Thus, information of an occurrence of a fire or an earthquake is conveyed reliably and smoothly and the jetting apparatus can be used quickly when necessary.

The alarm apparatus is removably attached to the jetting apparatus. Thus, the alarm apparatus can be used by a person to warn others or identify the location of persons.

The alarm apparatus is removably attached to the jetting apparatus with detachable mechanisms such as a string, a belt, a pin, a snap, a hook, a loop fastener, and a button.

In yet another specific aspect of the present invention, the alarm apparatus is configured to be portable and separable from the jetting apparatus for fire extinguishing gas. Thus, the alarm apparatus is used effectively and rationally.

According to the present invention, a lamp is disposed on the outside of the top case, and can be turned on when the sealing plate is pierced. Therefore, a person can easily and surely extinguish a fire in power failure or at night.

According to the present invention, a bottom case is slidably attached at a lower part of the top case, and the bottom case can receive the bottom of the gas cylinder. When the bottom case is operated to move upward, the bottom case or the cylinder holder moves upward to turn on the lamp, therefore, the lamp can be turned on concretely.

According to the present invention, a person can extinguish a fire easily and surely, and can use the lamp as emergency light after the fire is extinguished because the lamp can keep lighting after the sealing plate is pierced as described.

In yet another aspect of the present invention, a disaster warning system includes a jetting apparatus for fire extinguishing gas comprising a gas cylinder charged with pressurized fire extinguishing gas to which is attached a sealing plate on an opening thereof, a seal breaking member having a neb configured to break the sealing plate, a mouth part for the gas cylinder detachably attached to the gas cylinder, a cylinder holder formed therein with a guide hole which removably receives the seal breaking member therein, a seal breaking holder mounted with the seal breaking member and biased to an opposite side from the gas cylinder in a ready to deploy state, a passage communicable with the guide hole and a conducting hole which is open to outside, the fire extinguishing gas being sprayed out of the conducting hole through the passage, after the seal is broken. An accident alarm is configured to output an alarm after receiving a signal sent from fire detection signal or a vibration signal of predetermined intensity. The disaster warning system can be installed indoors. Further, the jetting apparatus is provided with an alarm apparatus configured to receive a signal from the accident alarm, with the alarm apparatus able to output a notification signal of voice, sound, or light, and further, the signal from the alarm apparatus identifying the location of the jetting apparatus when a fire or a predetermined vibration is detected. Thus, attachment of a fire detector and a vibration detector may be omitted. The accident alarm and the alarm apparatus are simple in structure, inexpensive, small, and light so that they are suitable to be attached to the small jetting apparatus. The jetting apparatus and the alarm apparatus are arranged in a manner such that they can be located apart from the accident alarm. In addition, a notification signal emitted by the alarm apparatus, such as sound or light signal, provides the location of the jetting apparatus reliably and quickly so that the jetting apparatus can be used quickly.

According to the present invention, an installation holder that has a pair of clutch arms facing each other is provided to be install on a wall, and the clutch arms detachably attach a lower end part of the top case there between. Then, a jetting apparatus for fire extinguishing gas is installed in place, thus, the gas cylinder is prevented from moving upward when the jetting apparatus for fire extinguishing gas is not used, and the gas cylinder is previously prevented from being accidentally pierced.

When the jetting apparatus for fire extinguishing gas is used, the jetting apparatus for fire extinguishing gas is pulled out of the clutching arms, and the gas cylinder is helped to move upward and be pierced. Thus, the jetting apparatus for fire extinguishing gas do not require complicated operation that the jetting apparatus for fire extinguishing gas is detached and the safety ring is pulled out. Therefore, this invention attempts to operate the apparatus easily and quickly and extinguish a fire early.

According to the present invention, an alarm apparatus is provided on a surface of or in the jetting apparatus for fire extinguishing gas. The alarm apparatus can work an alarm or/and an alarm lamp through a signal, which is sent from an accident alarm, for the occurrence of a fire or an earthquake that is sent from an accident alarm, and then notifies of the presence of the jetting apparatus for fire extinguishing gas. Therefore, the jetting apparatus for fire extinguishing gas can be used quickly and a fire can be extinguished early.

In one aspect of the present invention, a plurality of jetting apparatuses for fire extinguishing gas spray are installed in an area within range of an electric wave signal transmitted from the accident alarm. Thus, when the accident alarm transmits an alarm signal, the signal is outputted to the alarm apparatuses of each one of the jetting apparatuses for fire extinguishing gas spray. Thus, the alarm signal is quickly transmitted to each of the jetting apparatuses and the jetting apparatus can be quickly used.

Still more specifically, the alarm apparatus comprises a receiver configured to receive the alarm signal from the accident alarm, and a speaker or a voice guide recorder or an alarm lamp configured to operate when the receiver receives the signal. The structure is simplified by omitting attachment of fire detector and vibration detector. Thus, the alarm apparatus is inexpensive, small, light, and is suitable to be attached to a small fire extinguisher. In addition, a notification signal, such as sound or light, notifies location of the jetting apparatus for the fire extinguishing gas reliably and quickly so that the jetting apparatus may be used quickly.

According to the present invention, the alarm apparatus is removably attached on a surface of the jetting apparatus for fire extinguishing gas. Therefore, the alarm apparatus attempts to be used when the alarm apparatus is attached on and detached from the jetting apparatus for fire extinguishing gas.

According to the present invention, the alarm apparatus is detached from the jetting apparatus for fire extinguishing gas, and a person can wear the alarm apparatus. Thus, the person can notify of his/her existence, and this invention attempts to be useful to rescue and know safety of the person.

According to the present invention, there are two jetting apparatuses for fire extinguishing gas in the jetting apparatus for fire extinguishing gas. That is, one can be operated with one hand and is portable, and the other is large, heavy, operated with both hands and installed in place. Therefore, the present invention can broadly apply to jetting apparatuses of fire extinguishing gas regardless of size.

According to the present invention, a container is provided in the jetting apparatus for fire extinguishing gas. The container can store fire extinguishing powder, a fire extinguishing liquid chemical, a fire extinguishing chemical or fire extinguishing water; and the fire extinguishing gas can be brought in the container. The fire extinguishing powder, the fire extinguishing liquid chemical, the fire extinguishing chemical or the fire extinguishing water can be jetted from the jetting port, and is jetted by the fire extinguishing gas. Thus, this invention can be used in extinguishing various kinds of fires.

A signal from the fire detector which has sensed heat or smoke or a signal from the vibration detector which has sensed a vibration of a predetermined intensity is transmitted to the accident alarm. Thus, information of an occurrence of a fire or an earthquake is conveyed reliably and smoothly and the jetting apparatus can be used quickly when necessary.

Still more specifically, the alarm apparatus is removably attached to the jetting apparatus.

Still more specifically, the alarm apparatus is removably attached to the jetting apparatus with any one of a number of detachment mechanisms such as a string, a belt, a pin, a snap, a hook, a hook and loop fastener, and a button. Thus, the alarm apparatus may be attached in various ways.

Still more specifically, the alarm apparatus is configured to be worn by a person, who can be easily be found and rescued.

Still more specifically, the alarm apparatus is portable and can be separated from the jetting apparatus for fire extinguishing gas.

According to the present invention, a control valve that can intercept a passage communicating a through hole with a jetting port is provided in the passage. Thus, this invention prevents fire extinguishing gas, which is gushed after a sealing plate is pierced, from being released and being wasted, can accurately jet the fire extinguishing gas to a fire source, and attempts to use the fire extinguishing gas effectively and extinguish a fire early and effectively.

According to the present invention, the control valve can usually close so that the control valve can prevent the fire extinguishing gas, which gushes after the sealing plate is pierced, from being released and being wasted.

According to the present invention, the control valve can open on demand. Thus, this invention can accurately jet the fire extinguishing gas, which gushes after the sealing plate is pierced, to a fire source, and can realize that the fire extinguishing gas is used efficiently and the fire is extinguished early and effectively.

The present application discloses an invention including the accident alarm configured to output an alarm by a fire detection signal or a vibration detection signal of predetermined intensity, and an alarm apparatus that receives the alarm transmitted from the accident alarm and which apparatus then outputs a notification signal with sound or voice. Thus, the attachment of a fire detector and a vibration detector may be omitted from the accident alarm. The accident alarm and the alarm apparatus are simple in structure, inexpensive, small, and light so that they are suitable to be attached to a small jetting apparatus for fire extinguishing gas, such as a small hand held jetting apparatus The jetting apparatus to which the alarm apparatus is mounted is arranged such that it can be located apart from the accident alarm. In addition, a notification signal emitted by the alarm apparatus, such as sound or light, notifies of the location of the jetting apparatus reliably and quickly so that the jetting apparatus may be used quickly.

Specifically, the fire detector or the vibration detector and the accident alarm can be installed indoors, so that the detected signal transmitted from the fire detector or the vibration detector is able to be inputted to the accident alarm, which accident alarm transmits a signal to the alarm apparatus that is configured to receive a disaster warning electric wave signal transmitted from the accident alarm. The fire detector or the vibration detector, the accident alarm, and the alarm apparatus may be arranged apart from one another. Thus, an occurrence of a disaster is detected rationally and the information is transmitted rationally. In addition, the accident alarm and the alarm apparatus communicate wirelessly so that the jetting apparatus is able to be installed indoors at a desired position.

According to the present invention, the passage is formed in a piercing member holder and the control valve is disposed in a middle part of the passage so that the control valve opens or closes to surely control release or interception of the fire extinguishing gas that moves in the passage.

According to the present invention, a housing is disposed in a top case, and a control lever is turnably connected to an upper part of the housing, and the control lever is disposed on a surface of the top case. Moreover, the piercing member holder is fixed in the housing, a pushrod that can engage with the control valve is provided in an upper part of the piercing member holder to move vertically, the control lever is disposed to engage with the pushrod, and the control valve can surely open or close through the concrete structure for control.

Noting again, in a specific arrangement the alarm apparatus can include a receiver configured to receive an alarm signal from the accident alarm, and a microphone configured to collect the alarm signal, and a speaker or voice guide recorder configured to output a notification signal with sound or voice, or otherwise a visual signal from an alarm lamp, so that the alarm apparatus can receive the alarm signal easily and reliably and send an alarm signal through a variety of means.

In a particular arrangement of the present invention, a signal from the fire detector which has sensed heat or smoke or a signal from the vibration detector which has sensed a vibration of a predetermined intensity is transmitted to the accident alarm. Thus, information of an occurrence of a fire or an earthquake is conveyed reliably and smoothly and the jetting apparatus can be used quickly when necessary.

According to the present invention, the piercing member holder is disposed in an upper part of the housing, a cylinder holder is disposed in a lower part of the housing, and the cylinder holder can approach and be apart from the piercing member holder. Thus, the present invention can realize that the cylinder holder moves upward and the piercing member pierces a sealing plate when the sealing plate is broken; and the fire extinguishing gas is stored after the sealing plate is pierced.

According to the present invention, a tubular piercing member is disposed at a lower end part of the passage formed in the piercing member holder. The through hole can store the fire extinguishing gas gushed from the gas cylinder after the sealing plate is pierced, and the fire extinguishing gas that is stored in the through hole can be jetted form the jetting port when the control valve opens.

According to the present invention, the cylinder holder is provided so that the cylinder holder can move upward after the sealing plate is pierced, and the piercing member can be apart from the sealing plate. Thus, the present invention helps the fire extinguishing gas to gush from the gas cylinder, attempts to increase the capacity of the through hole, and can increase the quantity of the stored fire extinguishing gas.

Again, specifically, the alarm apparatus can removably attached to the jetting apparatus, such by fastening the alarm apparatus to the jetting apparatus with any one of detachable mechanisms such as string, a belt, a pin, a snap, a hook, a hook and loop fastener, and a button. The alarm apparatus 53 is configured to be portable and can separated from the jetting apparatus.

According to the present invention, a lamp is disposed on the outside of the top case, and can be turned on when the sealing plate is pierced. Therefore, a person can easily and surely extinguish a fire in power failure or at night.

According to the present invention, a bottom case is slidably attached at a lower part of the top case, and the bottom case can receive the bottom of the gas cylinder. When the bottom case is operated to move upward, the bottom case or the cylinder holder moves upward to turn on the lamp, therefore, the lamp can be turned on concretely.

According to the present invention, a person can extinguish a fire easily and surely, attempts to use the lamp as emergency light after the fire is extinguished and safely evacuate because the lamp can keep lighting after piercing the sealing plate as described.

In a specific arrangement, the invention comprises an accident alarm configured to output the signal transmitted by a fire detector after sensing a fire condition, or output the signal transmitted by a vibration detector after sensing vibration of predetermined intensity caused by a notable seismic event, such as an earthquake, which accident alarm is installed indoors, wherein the jetting apparatus is provided with an alarm apparatus configured to receive a signal transmitted by the accident alarm, with the alarm apparatus outputting a notification signal of voice, sound, or light. In this arrangement, the location of the jetting apparatus can be detected in an emergency situation brought on by fire or earthquake. Thus, attachment of a fire detector and a vibration detector to the jetting apparatus itself may be omitted. The accident alarm and the alarm apparatus are simple in structure, inexpensive, small, and light so that they are suitable to be attached to the small jetting apparatus for fire extinguishing gas. The jetting apparatus mounted with the alarm apparatus is arranged in a manner that it can be located apart from the accident alarm. In addition, a notification signal, such as sound or light, notifies location of the jetting apparatus reliably and quickly so that the jetting apparatus may be used quickly.

According to the present invention, an installation holder that has a pair of clutching arms facing each other is provided to be install on a wall, and the clutching arms can clutch a lower end part of the top case. Then, a jetting apparatus for fire extinguishing gas can be installed in place, thus, the gas cylinder is prevented from moving upward when the jetting apparatus for fire extinguishing gas is not used, and the gas cylinder can be previously prevented from being accidentally broken.

When the jetting apparatus for fire extinguishing gas is used, the jetting apparatus is pulled out of the clutching arms, and the gas cylinder is helped to move upward and be broken. Thus, the jetting apparatus for fire extinguishing gas do not require complicated operation that the jetting apparatus for fire extinguishing gas is detached and the safety ring is pulled out. Therefore, this invention attempts to operate the apparatus easily and quickly and extinguish a fire early.

According to the present invention, an alarm apparatus is provided on the surface of or in the jetting apparatus for fire extinguishing gas. The alarm apparatus can work an alarm or/and an alarm lamp through a signal, which is sent from an accident alarm, for the occurrence of a fire or an earthquake, and then notifies of the presence of the jetting apparatus for fire extinguishing gas. Therefore, the jetting apparatus for fire extinguishing gas can be used quickly and a fire can be extinguished early.

In a particular arrangement of the present invention, a plurality of jetting apparatuses for fire extinguishing gas spray are installed in an area within range of an electric wave signal transmitted from the accident alarm. Thus, when the accident alarm transmits an alarm signal, the signal is outputted to the alarm apparatuses provided on each one of the jetting apparatuses for fire extinguishing gas spray. Thus, the alarm signal is quickly transmitted to the location of each one of the jetting apparatuses and the jetting apparatus can be quickly used.

Still more specifically, the alarm apparatus comprises a receiver configured to receive the alarm signal from the accident alarm, and a speaker or a voice guide recorder or an alarm lamp configured to operate when the receiver receives the signal. The structure of the alarm apparatuses is simplified by omitting attachment of fire detector and vibration detector. Thus, the alarm apparatus is inexpensive, small, light, and is suitable to be attached to small fire extinguisher. In addition, a notification signal, such as sound or light, notifies location of the jetting apparatus for the fire extinguishing gas reliably and quickly so that the jetting apparatus may be used quickly.

According to the present invention, the alarm apparatus is removably attached on a surface of the jetting apparatus for fire extinguishing gas. Therefore, the alarm apparatus attempts to be used when the alarm apparatus is attached on and detached from the jetting apparatus for fire extinguishing gas.

According to the present invention, the alarm apparatus can be detached from the surface of the jetting apparatus for fire extinguishing gas, and a person can wear the alarm apparatus. Thus, the person can notify of his/her existence, and this invention attempts to be useful to rescue and know safety of the person.

According to the present invention, there are two jetting apparatuses for fire extinguishing gas in the jetting apparatus for fire extinguishing gas. That is, one can be operated with one hand and is portable, and the other is large, heavy, operated with both hands and installed in place. Therefore, the present invention can broadly apply to jetting apparatuses of fire extinguishing gas regardless of size.

In a particular arrangement of the present invention, a signal from the fire detector which has sensed heat or smoke or a signal from the vibration detector which has sensed a vibration of a predetermined intensity is transmitted to the accident alarm. Thus, information of an occurrence of a fire or an earthquake is conveyed reliably and smoothly and the jetting apparatus can be used quickly when necessary.

Still more specifically, the alarm apparatus is removably attached to the jetting apparatus.

According to the present invention, a container is provided in the jetting apparatus of fire extinguishing gas. The container can store fire extinguishing powder, a fire extinguishing liquid chemical, a fire extinguishing chemical or fire extinguishing water; and the fire extinguishing gas can be brought in the container. The fire extinguishing powder, the fire extinguishing liquid chemical, the fire extinguishing chemical or the fire extinguishing water can be jetted from the jetting port, and is jetted by the fire extinguishing gas. Thus, this invention can be used in extinguishing various kinds of fires.

Still more specifically, the alarm apparatus is removably attached to the jetting apparatus with any one of a number of detachment mechanisms such as a string, a belt, a pin, a snap, a hook, a hook and loop fastener, and a button. Thus, the alarm apparatus may be attached in various ways.

Still more specifically, the alarm apparatus is configured to be worn by a person, who can be easily be found and rescued.

Still more specifically, the alarm apparatus is portable and can be separated from the jetting apparatus for fire extinguishing gas.

BRIEF DESCRIPTION OF THE DRAWINGS

FIG. 4 shows a state that a sealing plate is not pierced yet.

FIG. 10 shows a state that the sealing plate is not pierced yet.

FIG. 13 shows a state that the control lever of the jetting apparatus of fire extinguishing gas is operated, the control valve opens, and fire extinguishing gas jets after the state described in the description of FIG. 12

DETAILED DESCRIPTION OF THE INVENTION

Figure 1:
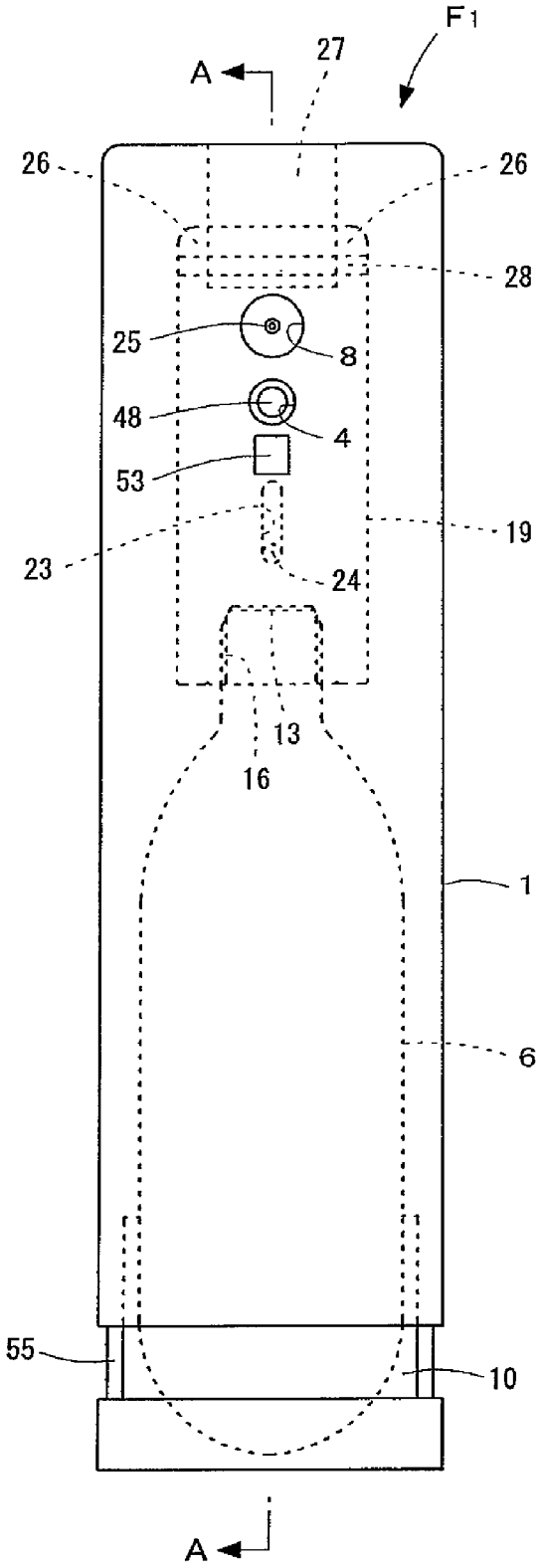
FIG. 1 is a front view of a small, light jetting apparatus for fire extinguishing gas that a basic aspect of this invention is applied thereto. The jetting apparatus for fire extinguishing gas is set and is charged with a gas cylinder, which is filled with carbon dioxide as fire extinguishing gas, before the jetting apparatus of fire extinguishing gas is used.
Figure 2:
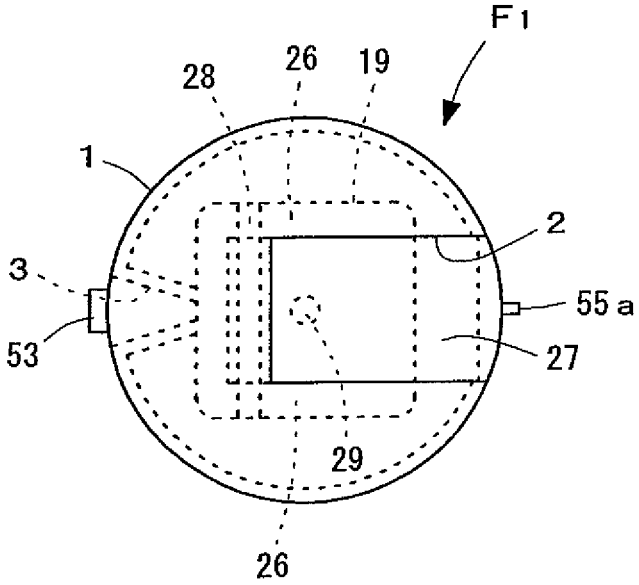
FIG. 2 is a plan view of FIG. 1.

The following is description of illustrated embodiments that a basic aspect of this invention is applied to a handy fire extinguisher $F_1$. The handy fire extinguisher $F_1$ is a jetting apparatus for fire extinguishing gas that uses a cartridge gas cylinder, is used in a house or a vehicle, and is small and light to be carried with one hand. Regarding FIGS. 1 to 7, reference numeral 1 denotes a top case that is made of synthetic resin and is hollow and almost tubular. The top case 1 consists of united cut cases that is a pair of halved cases that is axially cut in half along a centerline of a jetting port 3, a lower end of the top case 1 opens, an upper end of the top case 1 closes and is formed to be sloped backward and be approximately taper, and an opening 2 is formed at the center of the upper end of the top case 1.

A control lever, which is described later, is attached in the opening 2, the jetting port 3 is formed on a front upper peripheral surface of the top case 1 to face to a jetting hole, which is described later, and a lamp hole 4 is formed just under the jetting port 3 to be around a lamp, such as an LED.

Regarding the drawings, reference numerals 5, 6 and 7 are engaging pieces that are projected from the upper inside of the top case 1 and are disposed from an upper part to a lower part in the top case 1, the engaging pieces 6 and 7 are formed to be annularly projected from the upper inside of the top case 1, and guide holes 8 and 9 that are the same in shape are respectively formed in the center of the engaging pieces 6 and 7.

A bottom case 10 that is made of synthetic resin, bottomed and tubular is inserted in a lower end part of the top case 1 so that the bottom case 10 slidably contacts with the top case 1. The bottom case 10 is smaller than the top case 1, and the bottom of a known gas cylinder 11 is detachably fitted in the bottom case 10.

Regarding the drawings, reference numeral 12 is a step that is formed at a lower periphery of the bottom case 10, and the step 12 is formed to engage with a lower end part of the top case 1.

The gas cylinder 11 is charged with about 4 MPa of carbon dioxide as fire extinguishing gas, and a sealing plate 13 hermetically seals an upper end opening of the gas cylinder 11, a threaded part 14 is formed on the mouth of the gas cylinder 11, and is screwed to a cylinder holder 15 to be fixed. In the drawings, reference numeral 13*a* is a puncture that is punctured by a piercing member, which is described late.

The cylinder holder 15 is formed to be cylindrical through die casting of aluminum. A screw hole 16 that can screw the threaded part 14 therein is formed at a lower end of the cylinder holder 15, and a guide hole 17 is formed over the screw hole 16 to communicate with the screw hole 16. Reference numeral 18 is an O-ring that is disposed in a part communicating the screw hole 16 with the guide hole 17.

The inside of the guide hole 17 is smooth, and a guide shaft of a piercing member holder, which is described later, is slidably inserted into the guide hole 17.

An outer periphery of the cylinder holder 15 is slidably fitted in a housing 19 that is made of synthetic resin or die-cast aluminum. An outer periphery of the housing 19 is disposed to slidably contact with an inside end of the jetting port 3 and the guide holes 8 and 9.

The housing 19 is formed to be hollow and almost square tube. A slide hole 20 that is smooth is formed in the housing 19, and the piercing member holder 21 that is made of die-cast aluminum is fixed in a given position of an upper part of the slide hole 20 through a fastening 22, such as a pin and a screw.

Two long holes 23 that are vertically long and are formed to be disposed on the front and back peripheries of the housing 19 to face each other. Two fastening pins 24 project from the cylinder holder 15, and each fastening pin 24 is inserted in one of the long holes 23.

Ends of the fastening pins 24 are disposed to engage with engaging pieces 6, 7, therefore, upward or downward movement of the housing 19 is controlled, and the housing 19 can move with the top case 1.

In the drawings, reference numeral 25 is a jetting hole that is formed in an upper front part of the housing 19, and is disposed to face the inside of the jetting port 3.

A pair of brackets 26 projects from an upper end of the housing 19 to face each other. A proximal end of a control lever 27 is disposed between the brackets 26 by a pin 28 to connect with the brackets 26 and turn upward and downward. The other end of the control lever 27 is disposed to engage with an opening edge of the opening 2.

Regarding the drawings, reference numeral 29 is an engaging projection that projects from a lower end of the control lever 27, and is disposed to contact with the a pushrod, which is described later, just over the pushrod. Reference numeral 30 is an opening hole that opens at the center of an upper end part of the housing 19.

The seal breaking member holder 21 is formed to have the same diameter of the cylinder holder 15 and be almost tubular. A penetrating hole 31 that forms a passage for fire extinguishing gas is formed in an upper part of the seal breaking member holder 21, a conducting hole 32 forms the passage for fire extinguishing gas and has a small diameter. An end of the conducting hole 32 is formed to the penetrating hole 31, and the other end of the conducting hole 32 is disposed to face the jetting hole 25.

A valve attachment hole 33 that forms the passage on the same shaft of the penetrating hole 31 is formed in the seal breaking member holder 21, and a screw part is formed at an upper part of the valve attachment hole 33.

The pushrod 35 is inserted in the penetrating hole 31, a flange 36 projects from a middle part of the pushrod 35, and the flange 36 is disposed to engage with a lower end of the opening hole 30.

A spring 37 is inserted between the penetrating hole 31 and the flange 36, the pushrod 35 is biased upward through resilience of the spring 37 so that the pushrod 35 is disposed to engage an upper end of the pushrod 35 with the engaging projection 29 normally.

A control valve 38 is accommodated in the valve attachment hole 33, a screw part 39 of the control valve 38 is screwed up to the screw part 34, and a valve body of the control valve 38 hermetically engages with the valve attachment hole 33.

In the basic aspect of the present invention, the control valve 38 is an air valve of a tire tube for an automobile that is small, inexpensive, and is on sale.

The control valve 38 has a valve rod 40 that penetrates the control valve 38, and an inner valve 41 that can move with the valve rod 40. Further, the valve rod 40 and the inner valve 41 are biased upward by resilience of a valve spring (not shown) so that the inner valve 41 can be pushed to the valve body to open.

On the other hand, the pushrod 35 pushes down the valve rod 40, the inner valve 41 moves to a lower part of the valve body with the movement of the valve rod 40, and the inner valve 41 can open.

Then, the inside of the control valve 38 communicates to the penetrating hole 31 when the inner valve 41 opens, gushed fire extinguishing gas is brought in the control valve 38 after the sealing plate 13 is broken, and the fire extinguishing gas can be sent from the penetrating hole 31 to the conducting hole 32.

A spring 42, which is a volute spring in the embodiment, is inserted between the cylinder holder 15 and the seal breaking member holder 21, resilience of the spring 42 biases the seal breaking member holder 21 upward.

A guide shaft 43 projects downward form a lower end of the seal breaking member holder 21, the valve attachment hole 33 extends in the guide shaft 43.

A lower end of the valve attachment hole 33 is contracted from a middle part of the guide shaft 43 and opens at an end of the guide shaft 43, and a needle tube 45 that is a seal breaking member is disposed in a contracted part 44.

The needle tube 45 is formed from a steel tube that is diagonally cut at an end thereof, and a neb part 45*a* pierces to a thin part of the sealing plate 13 to break the sealing plate 13 easily and smoothly. Therefore, the center of the needle tube 45 is slightly offset to the center of the sealing plate 13.

Regarding the drawing, reference numeral 46 is an O-ring that is attached on the pushrod 35 in the seal breaking member holder 21, and reference numeral 47 is an O-ring that is attached in the neck of an end part of the guide shaft 43.

Further, a lamp 48, such as an LED, is provided in the lamp hole 4, leads 49 of the lamp 48 are connected to a battery 50 that is a power supply, terminals 51, 52 that are in the shape of a leaf spring are disposed to connected each other and insulating film (not shown) is inserted between the terminals 51, 52.

Among the terminals 51 and 52, the terminal 51 that is movable is disposed in the top case 1, and one end of the terminal 52 that is fixed is attached on the bottom case 10.

The insulating film normally prevents the terminals 51 and 52 from contacting each other. When the top case 1 moves downward to break the gas cylinder 11, the terminals 51 and 52 pass across the insulting film to contact each other, and the battery 50 keeps supplying electricity with the lamp 48 to turn on the lamp 48.

In the drawings, reference numeral 53 is an alarm apparatus. The alarm apparatus 53 is attached on the front of the top case 1. Further, the alarm apparatus 53 has a receiver (not shown) that can receive a signal from a fire alarm 54, which is an accident alarm; a microphone that can collect alarm sound from the fire alarm 54; band-pass filter or low-pass filter that can take off noise that is not the alarm; an amplifier that can amplify an inputted signal; a comparator that can compare with the standard of the alarm sound from the fire alarm 54 and can perform an operation; a transmitter and a speaker that can sound an alarm sound that is different from the alarm of the fire alarm 54 in tone; and a power supply that is, for example, a battery.

Besides the microphone, a lamp (not shown), such as an LED, can be provided for the alarm apparatus 53. The lamp can be turned on by the power supply working through a signal from the fire alarm 54.

Regarding the drawings, reference numeral 55 is a safety ring that is attached to cover half of a periphery of the bottom case 10, and is approximately half-annular and resilient. A grip part 55*a* projects from one end of the safety ring 55. The safety ring 55 is normally attached on the periphery of the bottom case 10. Therefore, the safety ring 55 can prevent an accident that the bottom case 10 is pushed in by a trick or false operation and the sealing plate 13 of the gas cylinder 11 is broken when the jetting apparatus for fire extinguishing gas $F_1$ is not used.

Further, in the basic aspect, the alarm apparatus 53 is disposed near the battery 50 and shares a power supply with the lamp 48 in the embodiment. Although an alarm signal is an alarm sound in the embodiment, the alarm signal is an alarm lamp for an alarm sound, or is used with the alarm sound. The alarm lamp can be turned on or blink.

Regarding the described basic aspect, the top case 1 and the housing 19 are separated, however, the top case 1 and the housing 19 can be united because the top case 1 and the housing 19 move together. Further, although the control lever 27 is attached on the housing 19 in the described embodiment, the control lever 27 can be attached on the top case 1.

In the basic aspect, the jetting apparatus for fire extinguishing gas $F_1$, which is composed as described, consists of the top case 1 and the bottom case 10 that receive the gas cylinder 11, the cylinder holder 15 that is screwed the screw part 14 of the mouth of the gas cylinder 11, the seal breaking member holder 21 that projects the needle tube 45, the housing 19 that accommodates the cylinder holder 15 and the seal breaking member holder 21 therein, the control lever 27, the control valve 38 that is included in the seal breaking member holder 21, and the alarm apparatus 53.

When the jetting apparatus for fire extinguishing gas $F_1$ is produced, the top case 1, the bottom case 10, the housing 19 and the control lever 27 are made of synthetic resin, the cylinder holder 15 and the seal breaking member holder 21 are made of die-cast aluminum, the control valve 38 is commercially available, and commercial electronics are assembled in a given circuit of the alarm apparatus 53 to produce the alarm apparatus 53.

When the described members are assembled, the seal breaking member holder 21 is accommodated in the upside of the housing 19 and the cylinder holder 15 is accommodated in the downside of the housing 19, and the spring 42 is inserted between the seal breaking member holder 21 and the cylinder holder 15.

Next, the guide shaft 43 of the seal breaking member holder 21 is inserted in the guide hole 17, and the fastening pins 24, 24 are respectively struck into the periphery of the cylinder holder 15 from the outside of the long holes 23, 23.

Further, ends of the fastening pins 24, 24 are fitted in the long holes 23, 23, respectively, and the seal breaking member holder 21 and the cylinder holder 15 are included in the housing 19.

When the members are included in, the control valve 38 and the pushrod 35 are included in the seal breaking member holder 21, and the needle tube 45 is attached at the downside of the guide shaft 43 beforehand.

First, when the control valve 38 is included in, the control valve 38 is inserted in the valve attachment hole 33 of the seal breaking member holder 21, and then the screw part 39 of the control valve 38 is screwed in the screw part 34 of the valve attachment hole 33 to be fitted in.

Next, the spring 37 is disposed just over the control valve 38 and under the pushrod 35 to be disposed between the control valve 38 and the pushrod 35, an upper end of the pushrod 35 is inserted in the open hole 30 of the housing 19 and projects from the housing 19.

Further, when the needle tube 45 is attached at the guide shaft 43, the needle tube 45 is pushed in the contracted part 44 of the valve attachment hole 33, the neb part 45*a* of the needle tube 45 projects from the guide shaft 43, and the needle tube 45 is disposed to be offset to the center of the guide shaft 43.

Before or after the seal breaking member holder 21 and the cylinder holder 15 are included in, the control lever 27 is disposed between a pair of the brackets 26 of the housing 19, a pin 28 is inserted in the base of the control lever 27, and the control lever 27 connects with the pin 28 to turn around the pin 28.

On the other hand, the battery 50 is attached on an engaging piece 6 of the halved cut cases of the top case 1, the lamp 48 is inserted in the lamp hole 4.

The alarm apparatus 53 is attached under the lamp hole 4 on the periphery of the top case 1, the leads 49 connect the lamp 48 with the battery 50, and leads (not shown) connect the described battery 50, which is used for the lamp 48 and the alarm apparatus 53, with the alarm apparatus 53.

Next, the terminal 51 is attached in the top case 1, the terminal 52 is attached outside of the bottom case 10, and the terminals 51 and 52 insert the insulting film there between and can contact each other to be conducted electrically.

Before or after the members are included in as described, the halved cut cases are disposed outside the housing 19 to face each other, are united by screws or an adhesive to be approximately cylindrical, the control lever 27 is disposed in the opening 2 of an upper end of the cut cases, and the bottom case 10 is put in a lower end of the cut cases.

Further, a safety ring 55 is fitted on the periphery of the bottom case 10 projecting from the lower end of the top case 1, upper and lower ends of the safety ring 55 are disposed to respectively engage with a lower part of the top case 1 and a flange part of the bottom case 10, and then a series of the production finishes.

Regarding the jetting apparatus for fire extinguishing gas $F_1$, which is assembled as described, the bottom case 10 is slightly pushed in the lower end of the top case 1 to be kept before the gas cylinder 11 is charged in the jetting apparatus for fire extinguishing gas $F_1$, and the jetting apparatus for fire extinguishing gas is formed to be cylindrical overall.

Then, the jetting port 3 and the lamp hole 4 are closely placed at the front of an upper part of the top case 1 so that the jetting port 3 is placed over the lamp hole 4. The jetting hole 25 is placed in the jetting port 3, the lamp 48 is attached in the lamp hole 4, and the alarm apparatus 48 is displayed just under the lamp 48.

The cylinder holder 15 is biased downward in the housing 19 by resilience of the spring 42 to be apart from the seal breaking member holder 21, and the fastening pins 24 respectively engage with the lower ends of the long holes 23 and rest in the engaging state.

Further, the valve body of the control valve 38 airtightly engages with the valve attachment hole 33 to be attached, the valve rod 40 is biased upward by a spring (not shown) that is attached in the control valve 38, and the inner valve 41 that moves with the valve rod 40 is pushed on a lower end of the valve body to keep the inner valve 41 closing.

The pushrod 35 that is above the control valve 38 is biased upward by resilience of the spring 37, an upper end part of the pushrod 35 projects to the outside of the housing 19, engages with the engaging projection 29 that is at a lower side of the control lever 27 to push up the control lever 27.

On the other hand, the end part of the fastening pins 24 engages with the engaging piece 7 that projects from the lowest potion among the engaging pieces 5, 6 and 7, and the top case 1 is apart from the bottom case 10.

Therefore, as the terminals 51 and 52 do not keep conducting not to be supplied electricity, the lamp 48 is turned off.

As the fire alarm 54 does not work at normal time when a fire does not occur, the alarm apparatus 53 stops working and does not sound an alarm sound.

Further, when the jetting apparatus for fire extinguishing gas $F_1$ is installed for use, the bottom case 10 is pulled out of the top case 1, the gas cylinder 11 that is not used is inserted from a lower side of the top case 1 into the top case 1, and the threaded part 14 that is on the periphery of a mouth of the gas cylinder 11 is screwed in the screw hole 16 of the cylinder holder 15 to be charged.

Then, the bottom case 10 is inserted in the lower end part of the top case 1, the bottom of the gas cylinder 11 is fitted in the bottom case 10, and the jetting apparatus for fire extinguishing gas $F_1$ is installed at a given place and in standing.

Figure 3:
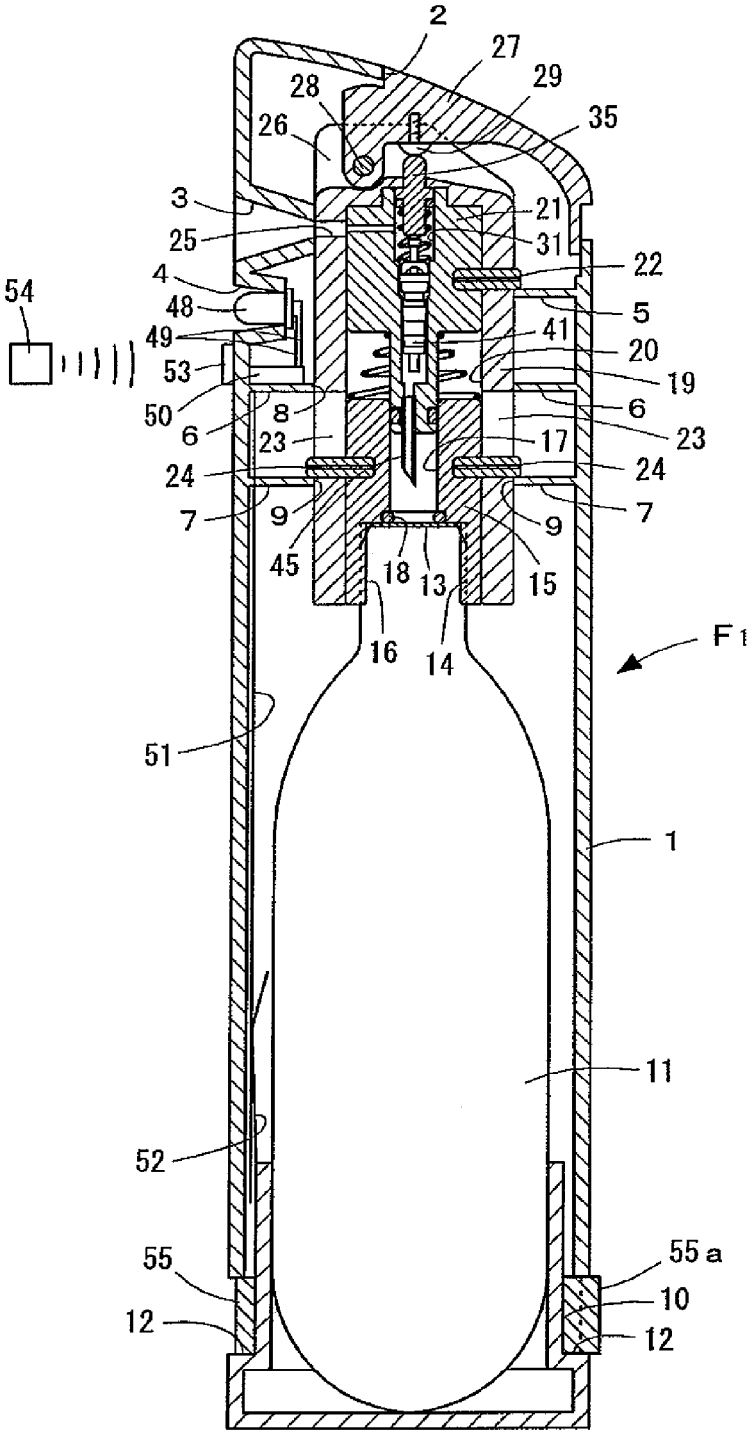
FIG. 3 is a sectional view taken along the line A-A of FIG. 1.
Figure 4:
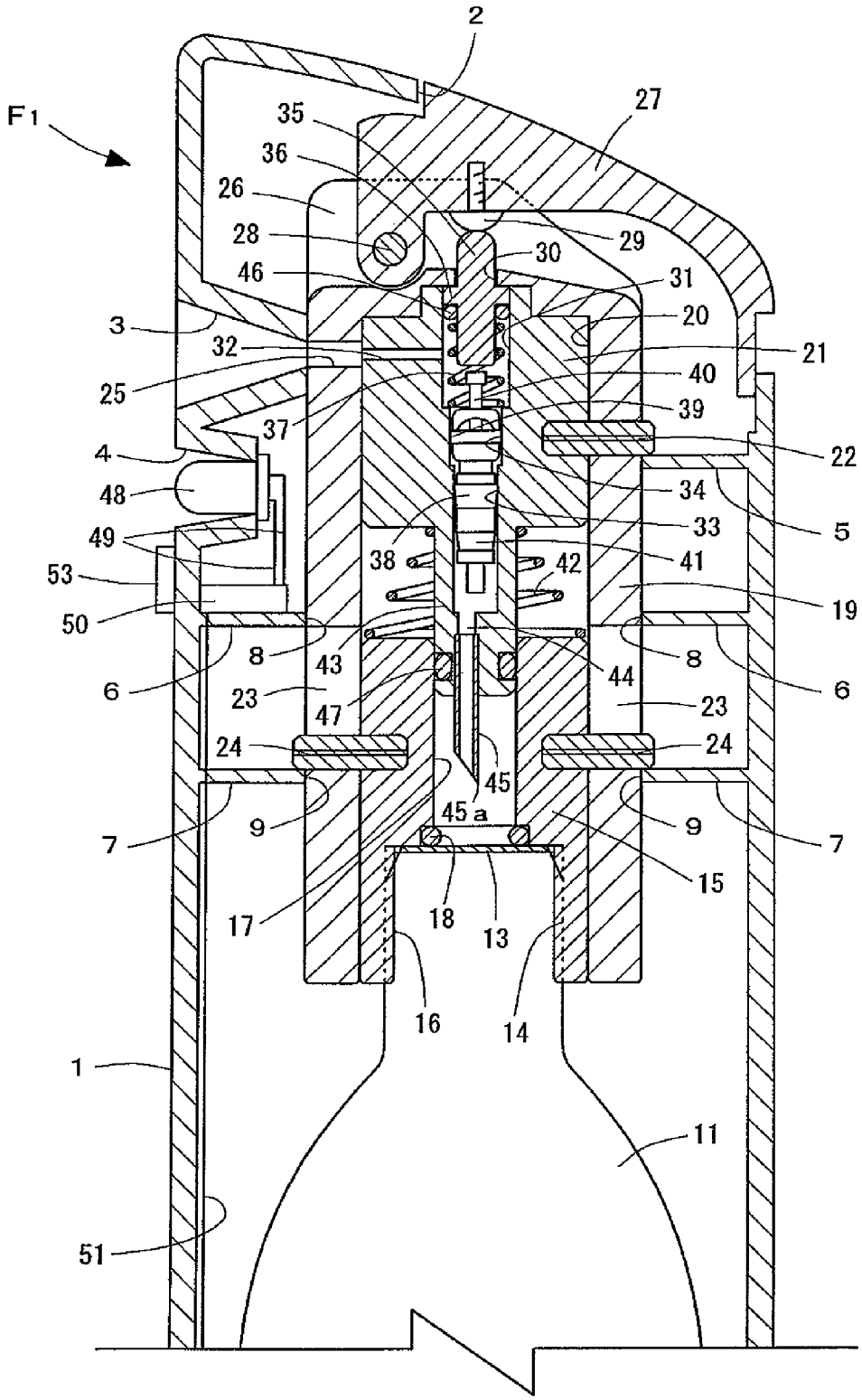
FIG. 4 is an enlarged sectional view showing an important part of FIG. 3.

When the jetting apparatus for fire extinguishing gas $F_1$ is installed as described, a suitable fixer fixes and prevents the jetting apparatus for fire extinguishing gas $F_1$ from falling down. This state is shown in FIGS. 1 and 3.

Regarding the jetting apparatus for fire extinguishing gas $F_1$ that charges the gas cylinder 11, the state is substantially the same with the state of the jetting apparatus for fire extinguishing gas $F_1$ that is assembled as described. That is, the neb part 45*a* of the needle tube 45 is placed above the sealing plate 13 to be apart from the sealing plate 13, the seal breaking member holder 21 is apart from the cylinder holder 15, and the conducting hole 32 and the jetting hole 25 of the housing 19 communicate to the jetting port 3.

When a fire occurs in installing the jetting apparatus for fire extinguishing gas $F_1$ as described, the fire alarm 54 automatically detects the fire or a person operate so that the fire alarm 54 works to sounds an alarm. When the alarm is inputted in the alarm apparatus 53, the alarm is detected by the receiver or the microphone (not shown) that are in the alarm apparatus 53, a signal inputted in the alarm apparatus 53 is amplified, and noise that is not the alarm is taken off. Further, when the alarm apparatus 53 recognizes that the alarm comes from the fire alarm 54, the transmitter sounds an alarm signal that is different from the alarm in tone.

Thus, the alarm signal informs persons where the jetting apparatus for fire extinguishing gas $F_1$ is, and helps to use the jetting apparatus for fire extinguishing gas $F_1$ quickly, and a fire can be extinguished early.

When a person finds the jetting apparatus for fire extinguishing gas, the person holds the jetting apparatus for fire extinguishing gas $F_1$, pulls the grip part 55*a* of the safety ring 55 to the side so that the safety ring 55 is removed from the periphery of the bottom case 12, and the bottom case 12 can be pushed in the top case 1.

Then, the person holds the jetting apparatus for fire extinguishing gas $F_1$ and pushes up the bottom case 12, or the person puts the jetting apparatus for fire extinguishing gas $F_1$ on the floor and pushes down the head of the top case 1 against resilience of the spring 42.

Thus, the top case 1 moves toward the bottom case 12 against resilience of the spring 42, or the bottom case 12 is pushed into the top case 1, and the terminal 51 relatively moves with the top case 1. Then, after the terminal 51 passes an interposing position of the insulating film (not shown), the terminal 51 contacts with the terminal 52, which is the other terminal, to electrically conduct to the terminal 52.

Therefore, a person can easily find the origin of a fire at night, etc., and can surely act to extinguish the fire. After the person extinguishes the fire, the person can use the lamp 48 as guide lamp in escape.

Figure 5:
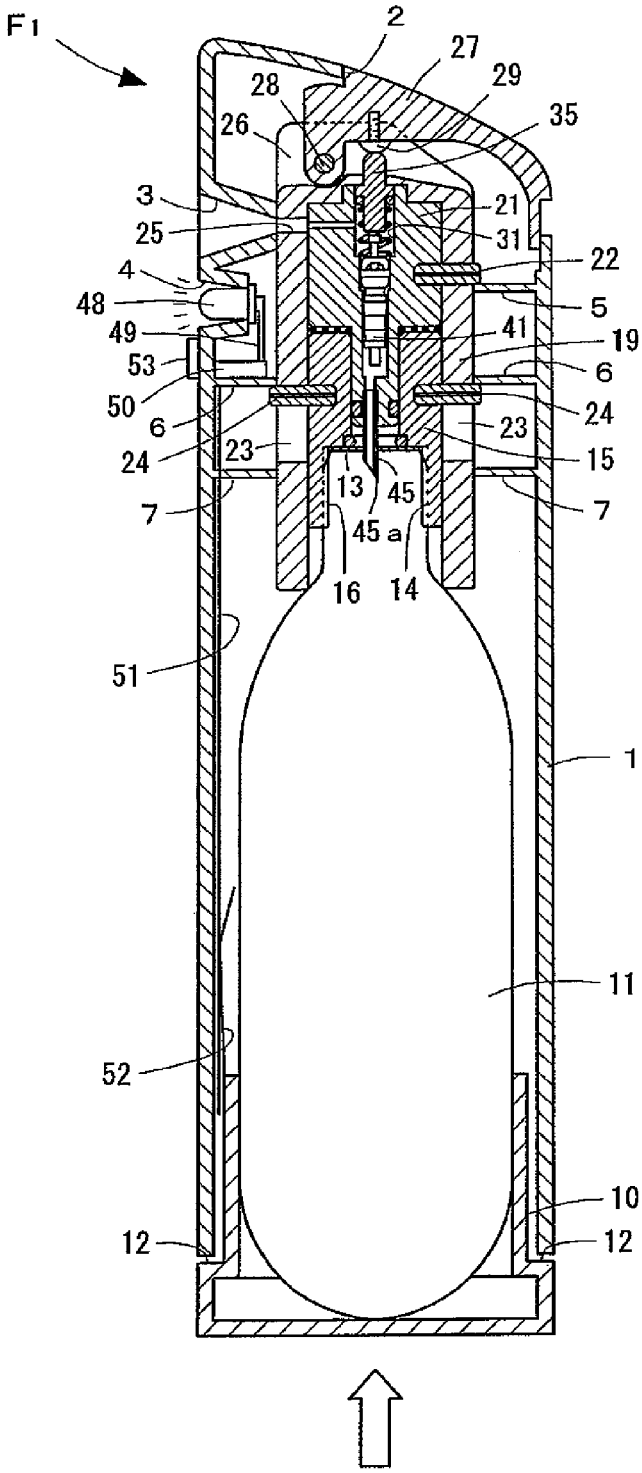
FIG. 5 is a sectional view showing a basic aspect of the jetting apparatus for fire extinguishing gas in use. A bottom case is pushed to move with a piercing member holder and turn on a lamp, and a piercing pipe pierces the sealing plate to break the sealing plate.
Figure 6:
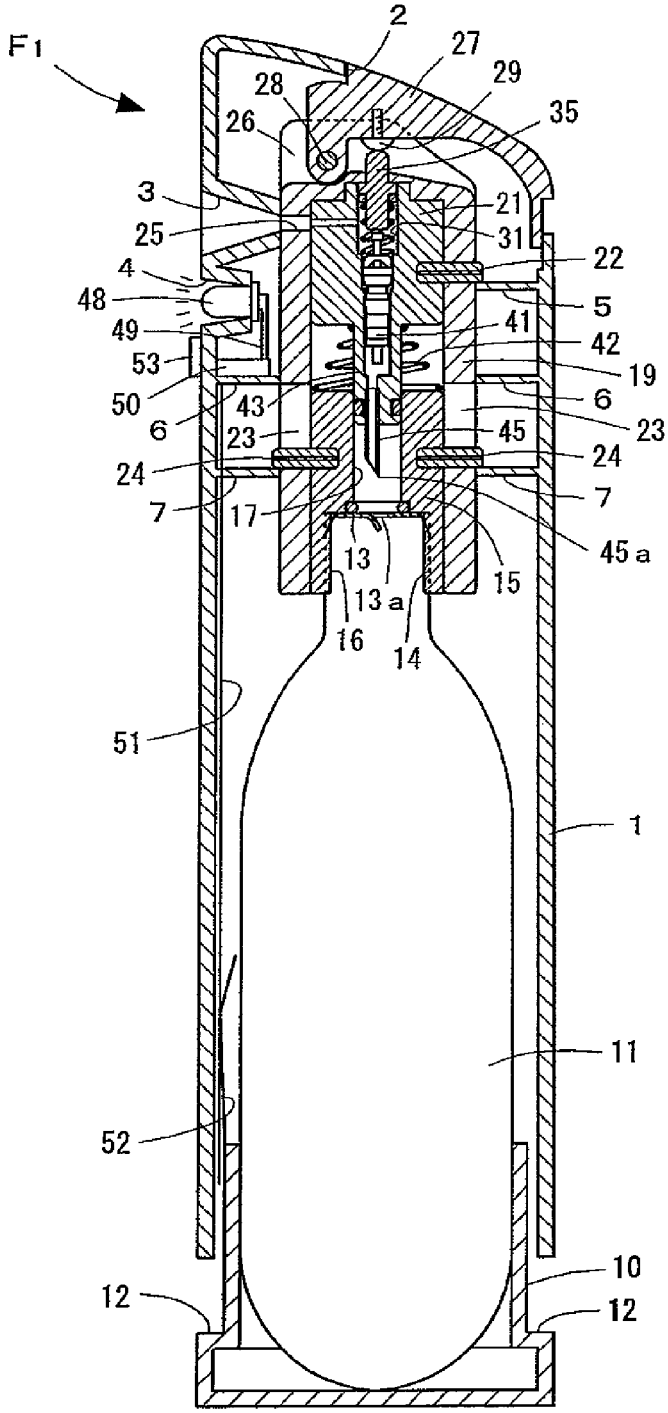
FIG. 6 is a sectional view showing a basic aspect of the jetting apparatus for fire extinguishing gas in use. Gushed fire extinguishing gas returns the bottom case and the piercing member holder immediately after the seal piercing.
Figure 7:
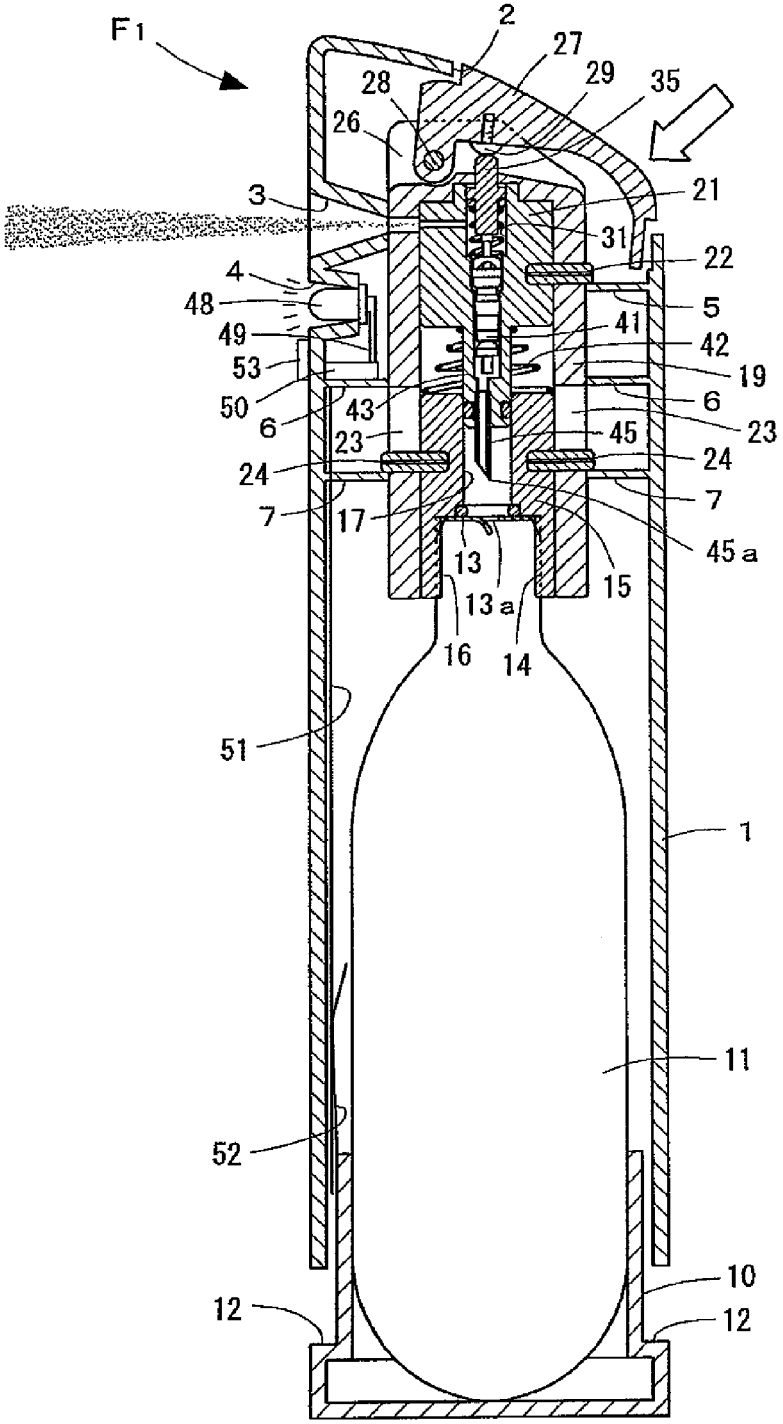
FIG. 7 is a sectional view showing a basic aspect of the jetting apparatus for fire extinguishing gas in use. A control lever is pushed to open a control valve, and fire extinguishing gas gushes from a jetting hole after the sealing plate is pierced.
Figure 8:
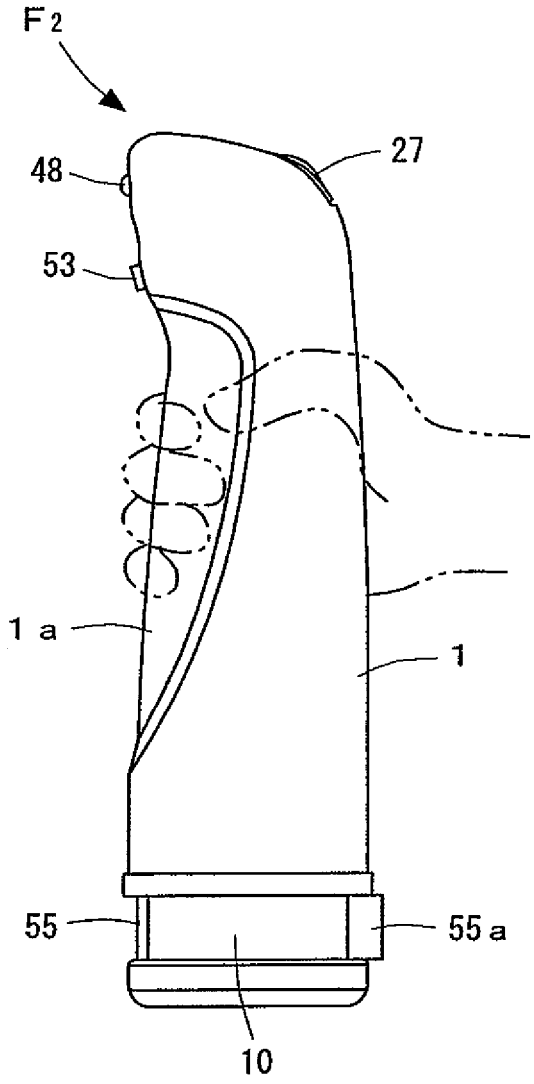
FIG. 8 is a side view of a first embodiment of this invention showing a small and light jetting apparatus for fire extinguishing gas before use (i.e., a ready-to-use state)
Figure 9:
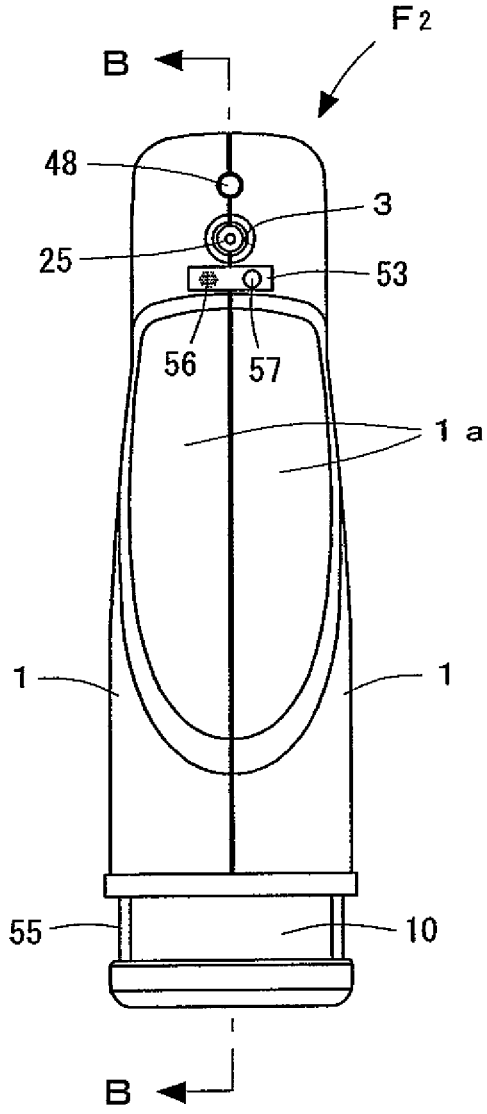
FIG. 9 is a front view of FIG. 8.
Figure 10:
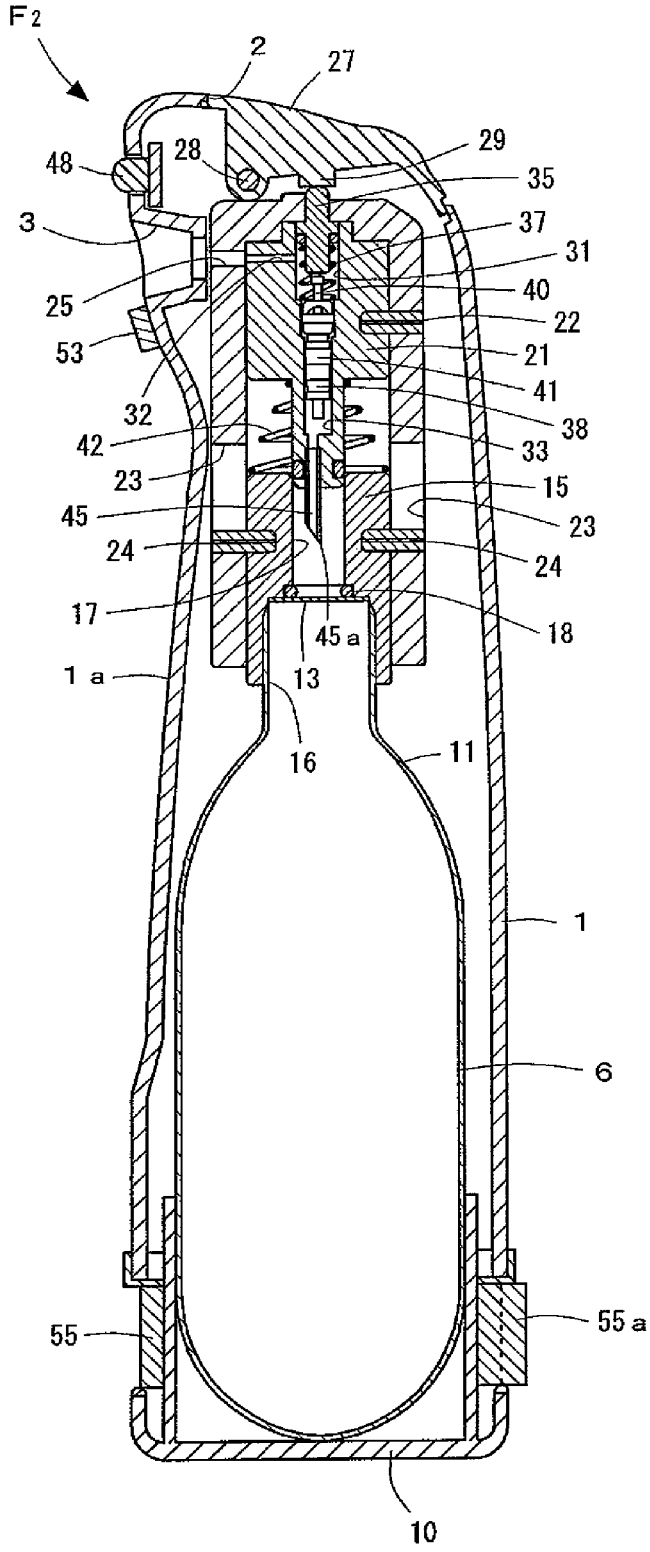
FIG. 10 is an enlarged sectional view taken along the line B-B of FIG. 9.
Figure 11:
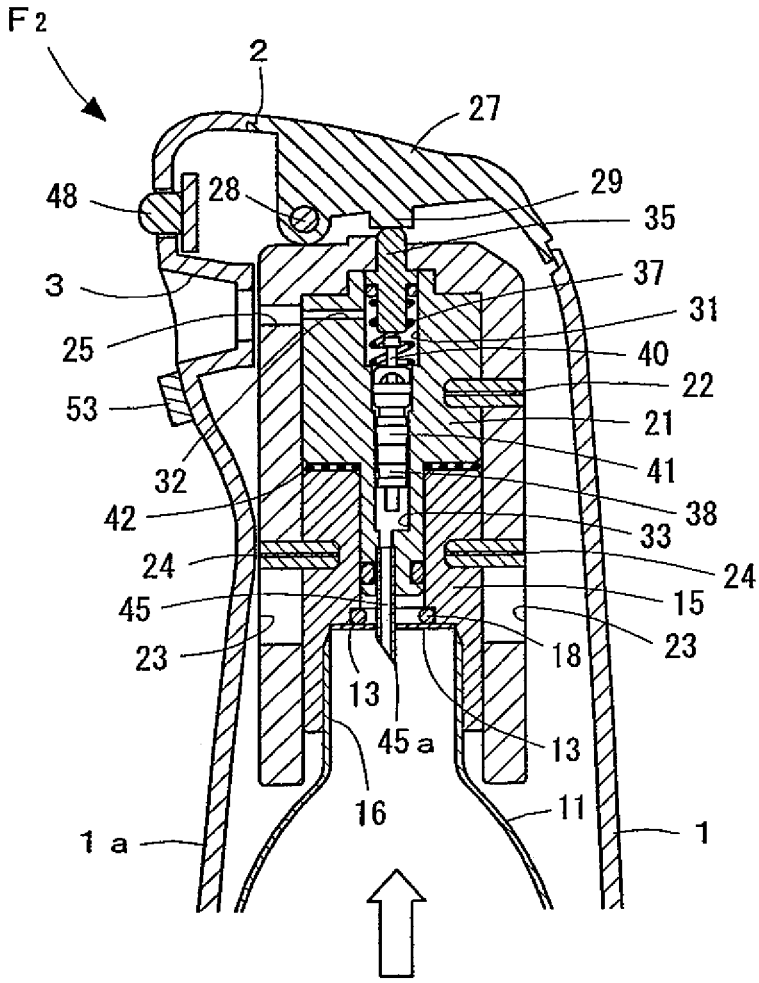
FIG. 11 is a sectional view of the upper part of the jetting apparatus of the first embodiment showing a state in which the seal has been pierced by pushing up the bottom case to move the cylinder holder.
Figure 12:
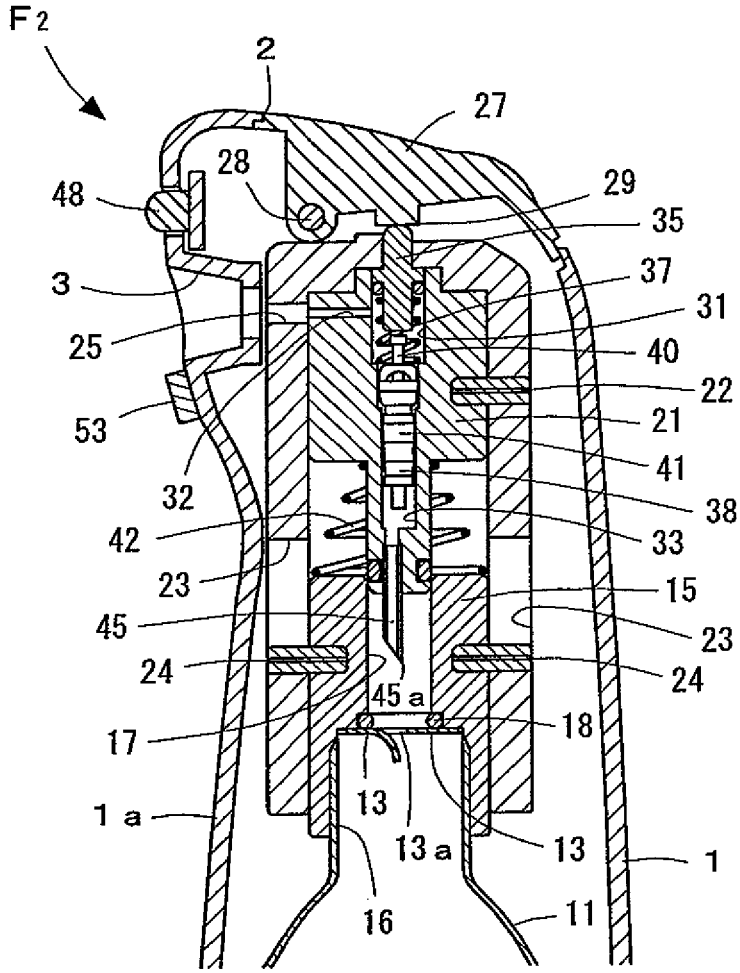
FIG. 12 shows a state that gushed fire extinguishing gas returns a bottom case and a piercing member holder right after the sealing plate is pierced in FIG. 11.
Figure 13:
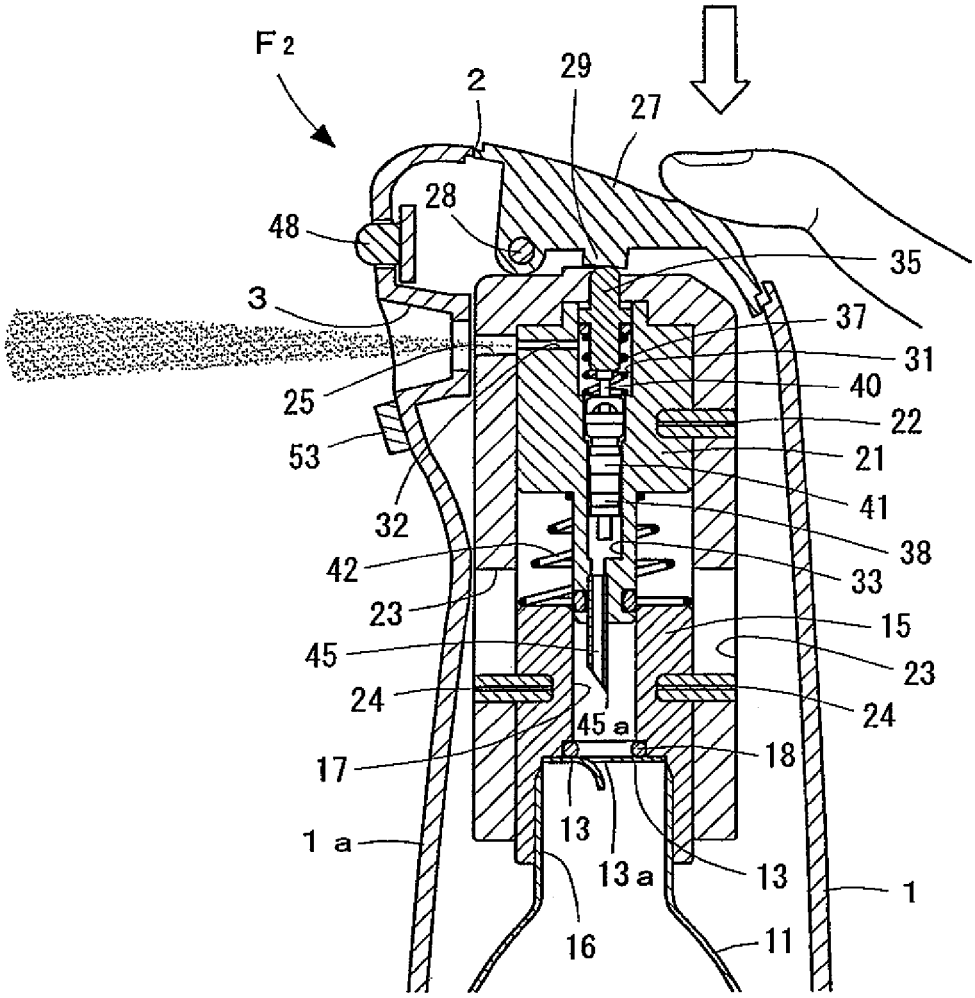
FIG. 13 is a sectional view.
Figure 14:
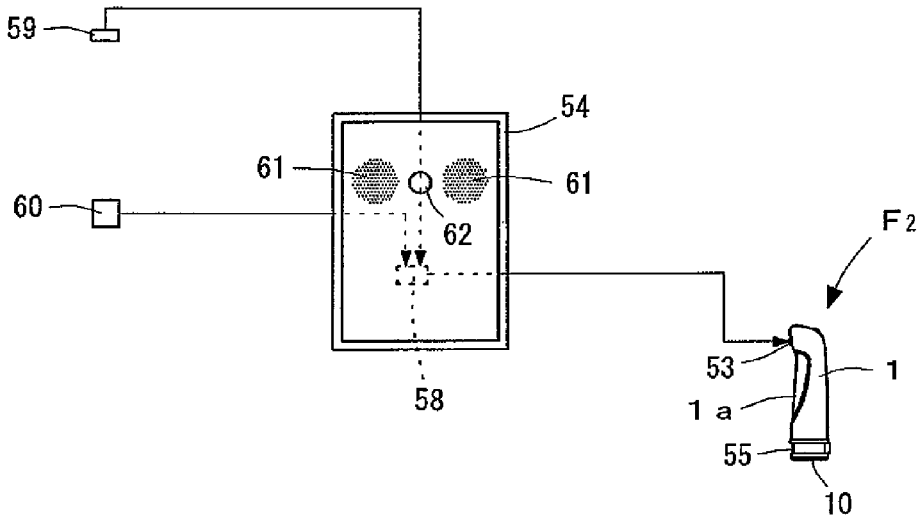
FIG. 14 is an explanatory view showing a state of inputting a signal from the accident alarm to the alarm apparatus which is affixed to the jetting apparatus of the first embodiment.

Next, the lamp 48 is turned on until the voltage of the battery 50 is consumed to be less than a predetermined voltage. This state is shown in FIG. 5.

Further, when the bottom case 12 is pushed up, or the head of the top case 1 is pushed down as descried, the gas cylinder 11 relatively moves upward, the cylinder holder 15 moves with the gas cylinder 11 and pushes the spring 42 to contract the spring 42, and the fastening pins 24 that projects from the cylinder holder 15 moves upward along the long holes 23. Then, the mouth of the gas cylinder 11 approaches the neb part 45*a* of the seal breaking member 45, and the sealing plate 13 is pierced by the neb part 45*a* to be broken.

In this case, the sealing plate 13 can be broken rationally and easily because the neb part 45*a* pierces the thin, center part of the sealing plate 13.

Further, the cylinder holder 15 moves upward in the housing 19 to move for the vertical length of the long holes 23, the fastening pins 24 engage with an upper end part of the long holes 23, respectively, and then the cylinder holder 15 stops moving upward and the needle tube 45 stops piercing. This state is shown in FIG. 5.

In this case, as the seal breaking member holder 21 is fixed in the housing 19, the jetting port 3, the jetting hole 25 and the conducting hole 32 maintain communicating.

Thus, when the sealing plate 13 is broken, fire extinguishing gas of the gas cylinder 11 moves through the needle tube 45 to gush, and moves to the valve attachment hole 33 that is in the guide shaft 43.

As the valve attachment hole 33 is airtightly sealed by the control valve 38 and the inner valve 41 maintain closing in this case, the fire extinguishing gas that moved to the valve attachment hole 33 stays instead of flowing toward the penetrating hole 31, and pressure of the fire extinguishing gas works on the control valve 38 and a lower part of the seal breaking holder 21.

Therefore, the cylinder holder 21 is pushed up by the pressure of the fire extinguishing gas, the housing 19 moves with the cylinder holder 21, the seal breaking member holder 21 is apart from the cylinder holder 15, and the needle tube 45 is pulled out of a broken part of the sealing plate 13.

At the same time, the long holes 23 moves along the fastening pins 24 to help the housing 19 to move vertically. When lower end parts of the long holes 23 touches the fastening pins 24, the long holes 23 stop moving.

The state that is described above is shown in FIG. 6. The guide shaft 43 that is a part of the seal breaking member holder 21 moves to an upper part of the through hole 17 to enlarge a space of the through hole 17, a broken hole 13*a* opens at the sealing plate 13 and communicates with the through hole 17, and the through hole 17 stores fire extinguishing gas of the gas cylinder 11.

In this case, the state is the same as the described state. That is, as the control valve 38 airtightly seals the valve attachment hole 33, and the inner valve 41 maintains closing, the fire extinguishing gas that moved to the valve attachment hole 33 stays instead of flowing toward the penetrating hole 31.

As described above, in the basic aspect of the jetting apparatus for fire extinguishing gas $F_1$, the fire extinguishing gas, which gushes after seal piercing, is stopped in the through hole 17 and outflow is prevented. Thus, this invention prevents a state of gas waste and gas outflow, which can occur in a conventional jetting apparatus.

Further, a space that the fire extinguishing gas stays is a little larger than the space that is made in seal breaking according to FIG. 5, however, the capacity of the space that the fire extinguishing gas stays is much smaller than the capacity of the gas cylinder 11. Therefore, the gushed gas is not depressurized to keep liquefying.

On the other hand, the control lever 27 that is attached on the housing 19 moves with moving up of the housing 19, and the top case 1 that engages with the base of the control lever 27 moves with the housing 19 to be apart from the bottom case 10.

Thus, the terminal 52 approaches the terminal 51, however, the battery 50 energizes the lamp 48 to keep the lamp 48 being turned on because the terminals 51 and 52 continue to conduct each other.

At the same time, the housing 19 moves upward with the seal breaking member holder 21 to move for the vertical length of the long holes 23, the top case 1 moves with the housing 19 through the control lever 27, and the jetting hole 25, the jetting port 3 and the conducting hole 32 keep communicating.

Under the described state, a person holds the jetting apparatus for fire extinguishing gas $F_1$ with one hand while directs the jetting port 3 to the origin of a fire; and pushes down an end part of the control lever 27 against resilience of the spring 37.

Then, the control lever 27 turns around the pin 28 to move downward, the engaging projection 29 that is attached on a lower surface of the control lever 27 pushes down an upper end part of the pushrod 35 upward, a lower end part of the pushrod 35 engages with an upper end part of the valve rod 40, and the valve rod 40 is pushed down against resilience of the spring 37.

Therefore, the inner valve 41 moves with the valve rod 40, is apart from a lower end part of the valve body and is pushed to open.

As a result, the inside of the control valve 38 opens to communicate a lower part of the valve attachment hole 33 with the penetrating hole 31 by the control valve 38.

Further, the fire extinguishing gas moves in the control valve 38 to be conducted from the penetrating hole 31 to conducting hole 32, and moves from the jetting hole 25 to the jetting port 3 to jet to the origin of a fire.

In this case, a part of jetted carbon dioxide is insulated and expanded to be dry iced, and then is mixed with gaseous carbon dioxide to jet to the origin of a fire.

Therefore, as the temperature decreases around the origin of a fire and oxygen is prevented from being supplied around the origin of a fire, the fire is extinguished efficiently and quickly.

Thus in the basic aspect of the jetting apparatus for fire extinguishing gas $F_1$, the fire extinguishing gas that gushed after seal breaking stays once, and the jetting hole 25 precisely directs to the origin of a fire to jet the fire extinguishing gas, consequently, the fire extinguishing gas jets to the origin of a fire precisely and efficiently without being wasted, and the fire can be extinguished rationally and quickly.

Further, when the person stops pushing the control lever 27 in the fire extinguishing gas jetting, the control lever 27 is pushed by resilience of the spring 37 to return upward, and the pushrod 35 stops pushing the valve rod 40.

Therefore, the valve rod 40 is pushed upward by resilience of the spring that is included in the control valve 38 to return, the inner valve 41 moves with the valve rod 40, and the inner valve 41 tightly contacts with a lower end part of the valve body to close.

Consequently, the inside of the control valve 38 is closed, a lower part of the valve attachment hole 33 and the penetrating hole 31 is prevented from communication, gas that gushes from the jetting hole 25 stops gushing, the fire extinguishing gas that gushed from the broken part stays in the through hole 17, the valve attachment hole 33 that is in the guide shaft 43, and needle tube 45.

The staying gas gushes from the jetting hole 25 if the control lever 27 starts being pushed, the fire extinguishing gas can be effectively used without being wasted.

In addition, after the fire extinguishing gas is completely used, the bottom case 10 is pulled out of the top case 1, a lower part of the shown gas cylinder 11 is held to turn, the threaded part 14 that is at the mouth of the gas cylinder 11 is remove from the screw hole 16 of the cylinder holder 15, and then the empty gas cylinder 11 can be collected.

Next, a new gas cylinder 11 is prepared, a threaded part 14 that is at a mouth of the gas cylinder 11 is screwed into the screw hole 16 to be charged, and the bottom case 10 is inserted in a lower end part of the top case 1, consequently, the new gas cylinder can be used. Thus, the basic aspect of the jetting apparatus for fire extinguishing gas $F_1$ can be used repeatedly and efficient use can be achieved.

According to the applied embodiment the basic aspect of the present invention, a powder container filled with fire extinguishing powder is disposed between the jetting hole 25 and the conducting hole 32 or in a proper part, fire extinguishing gas that gushed from the gas cylinder 11 is conducted to the powder container, and the fire extinguishing powder filled in the powder container can gush from the jetting hole 25.

In addition, when pure water or a fire extinguishing liquid chemical is stored in the container and jets by the fire extinguishing gas while the pure water or the fire extinguishing liquid chemical is atomized or foamed, this invention can be used in a fire caused by a chemical, a liquid chemical and electricity.

The other embodiment of this invention is shown in FIGS. 8 to 20, and the same reference numerals are used in parts that correspond with the parts of the described basic aspect.

Of them, FIGS. 8 to 14 show the first embodiment of this invention and the embodiment is applied to another jetting apparatus for fire extinguishing gas $F_2$ that is small, light and can be carried with one hand.

Regarding the jetting apparatus for fire extinguishing gas $F_2$ in the first embodiment, recesses 1*a* and 1*a* are formed at a middle upper part on the front of top cases 1 and 1, so that a person can easily hold the jetting apparatus for fire extinguishing gas $F_2$ with one hand; a lamp 48 is provided over a jetting port 3 that is at an upper part of the top cases 1 and 1, so that the lamp 48 improves in lighting effect.

In order to turning on the lamp 48, a circuit of the power supply is closed through upward displacement of the cylinder holder 15 caused by pushing in the bottom case 10 instead of displacement caused by pushing in the bottom case 10. Therefore, the embodiment strives to simplify wiring and turn on the lamp 48 surely.

An alarm apparatus 53 is provided under the jetting port 3. The alarm apparatus 53 has a speaker 56, an alarm lamp 57, such as an LED, and a receiver (not shown) that can receive a signal of a transmitter 58 provided in an accident alarm 54, and the speaker 56 and/or the alarm lamp 57 can work through reception by the receiver.

The transmitter 58 is provided with an alarm or a voice guide, an electric wave or an electric signal, and an oscillator configured to make an alarm lamp blink. A signal from a fire detector 59, such as a heat sensor or a smoke detector, configured to detect occurrence of a fire, and a signal from a vibration detector 60 configured to detect vibration that may correspond to a predetermined Japanese seismic scale may be inputted to oscillator 58.

When the signals of the detectors are inputted in the transmitter 58, the transmitter 58 works. The transmitter 58 works to run a speaker 61, a voice guide recorder, an oscillator or an alarm lamp 62, which are provided in the accident alarm 54. Thus, the transmitter 58 can alarm for an occurrence of a fire or an earthquake by hearing and seeing.

The voice guide announces, for example, "There is a fire. Calm down and escape", "The emergency exit is ahead", "There is an earthquake. Calm down and take refuge", and "There is an earthquake. Make sure the fire is out", to inform of occurrence of an accident and instruct to make sure of an escapeway.

Regarding the jetting apparatus for fire extinguishing gas $F_2$ as described, the fire detector 59 detects a fire to input a signal in the transmitter 58, the speaker 61 sounds an alarm and a voice guide. The alarm and the voice guide announce, "There is a fire. Calm down and escape", and "The emergency exit is ahead", etc. and the alarm lamp 57 blinks on and off to inform of occurrence of a fire.

On the other hand, the signal for a fire is inputted from the transmitter 58 into the alarm apparatus 53, which is attached on the jetting apparatus for fire extinguishing gas, and then an alarm sounds from a speaker 56 of the alarm apparatus 53 and a alarm lamp 57 blinks on and off to inform presence of the jetting apparatus for fire extinguishing gas.

Therefore, a user can find the jetting apparatus for fire extinguishing gas $F_2$ easily and quickly, and can operate the jetting apparatus for fire extinguishing gas $F_2$ as described so that the user can accurately and effectively jet carbon dioxide from the jetting hole 25 to the origin of a fire to extinguish the fire.

Further, in case an earthquake that is a predetermined Japanese seismic scale is occurs, the vibration detector 60 detects an earthquake occurring to input a signal in the transmitter 58, the speaker 61 sounds an alarm and a voice guide. The alarm and the voice guide announce, "There is an earthquake. Calm down and take refuge", and "There is an earthquake. Make sure the fire is out", etc. and the alarm lamp 62 blinks on and off to inform of occurrence of an earthquake.

Next, an alarm signal for an earthquake is inputted from the transmitter 58 into the alarm apparatus 53, which is attached on the jetting apparatus for fire extinguishing gas $F_2$, and then an alarm sounds from the speaker 56 of the alarm apparatus 53 and the alarm lamp 57 blinks on and off to inform presence of the jetting apparatus for fire extinguishing gas. Thus, a user can quickly deal with a fire when a fire occurs after an earthquake.

As the speaker 61 sounds and the alarm lamp 57 blinks on and off after fire fighting or an earthquake, a user moves while holding the used jetting apparatus for fire extinguishing gas $F_2$ to escape safely. Further, as the user informs of his/her existence, the user can be found easily, and then can be rescued and helped quickly and easily.

In addition, in the basic aspect of the present invention and in the first embodiment, the alarm apparatus 53 is attached on the periphery of the jetting apparatus for fire extinguishing gas $F_1$, $F_2$. The alarm apparatus 53 may be fitted into the jetting apparatus. By doing so, the alarm apparatus 53 is protected and the better appearance of the jetting apparatus $F_1$, $F_2$ is obtained.

Figure 15:
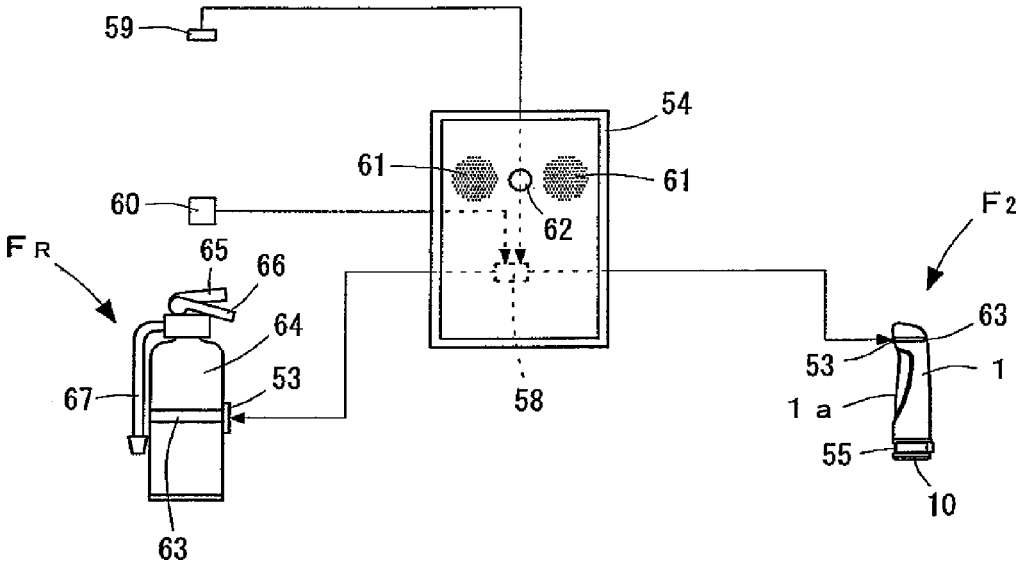
FIG. 15 is an explanatory view of a second embodiment of the present invention in which an alarm apparatus is removably attached to each of a small and light jetting apparatus and to a large and heavy jetting apparatus, in which an alarm signal emitted in the case of a fire or an earthquake is transmitted from the accident alarm to each of the alarm apparatuses.
Figure 16:
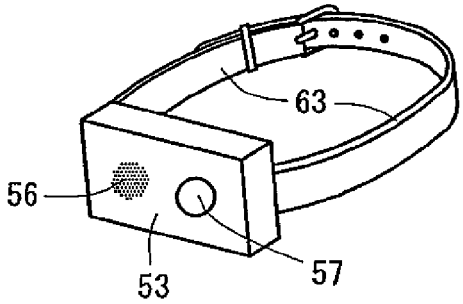
FIG. 16 is a perspective view of a detachable alarm apparatus employed in the second embodiment.
Figure 17:
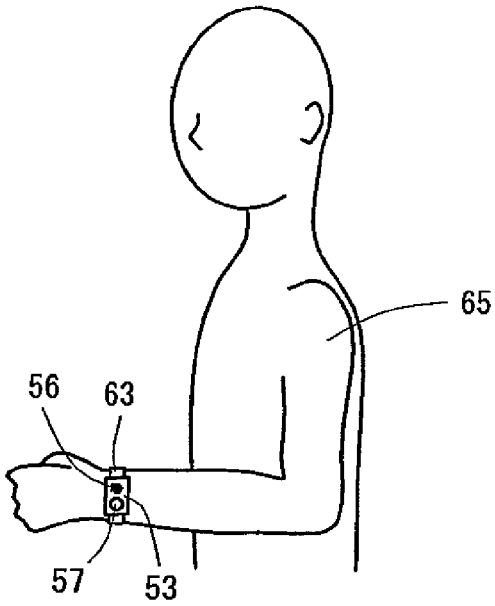
FIG. 17 is an explanatory view. The alarm apparatus in FIG. 16 is detached from the jetting apparatus for fire extinguishing gas and a person wears the alarm apparatus to use the alarm apparatus.

The second embodiment of the present invention is shown in FIGS. 15 to 17. In the second embodiment, instead of attaching the alarm apparatus 53 integrally to the jetting apparatus for fire extinguishing gas $F_1$ and $F_2$, it is removably attached to the jetting apparatus $F_1$ and $F_2$ with string or the belt 63.

Thus, the jetting apparatuses for fire extinguishing gas $F_1$ and $F_2$ attempt to be simplified in structure. Further, the alarm apparatus 53 can be easily attached on the jetting apparatuses for fire extinguishing gas $F_1$ and $F_2$, which have already installed, later as supplement; improves in being used and replaced; can be attached on a trunk part of a jetting apparatus for fire extinguishing gas $F_R$ that is conventionally used and is large and heavy; and then can be used well.

Further, after disaster or in refuge, a person removes the alarm apparatus 53 from the jetting apparatus for fire extinguishing gas $F_1$, $F_2$ or $F_R$ and wears the alarm apparatus 53 on the body, such as wrist or arm, and then the person 65 can be found and rescued easily and his/her safety can be known easily.

Reference numeral 65 is a movable lever that is attached on an upper part of the jetting apparatus for fire extinguishing gas $F_R$ to turn upward and downward, reference numeral 66 is an immovable lever, and reference numeral 67 is a hose nozzle in the drawing.

Incidentally, the alarm apparatus 53 may be attached and detached through a pin, a snap, a hook and loop fastener and a button to be detachable.

Figure 18:
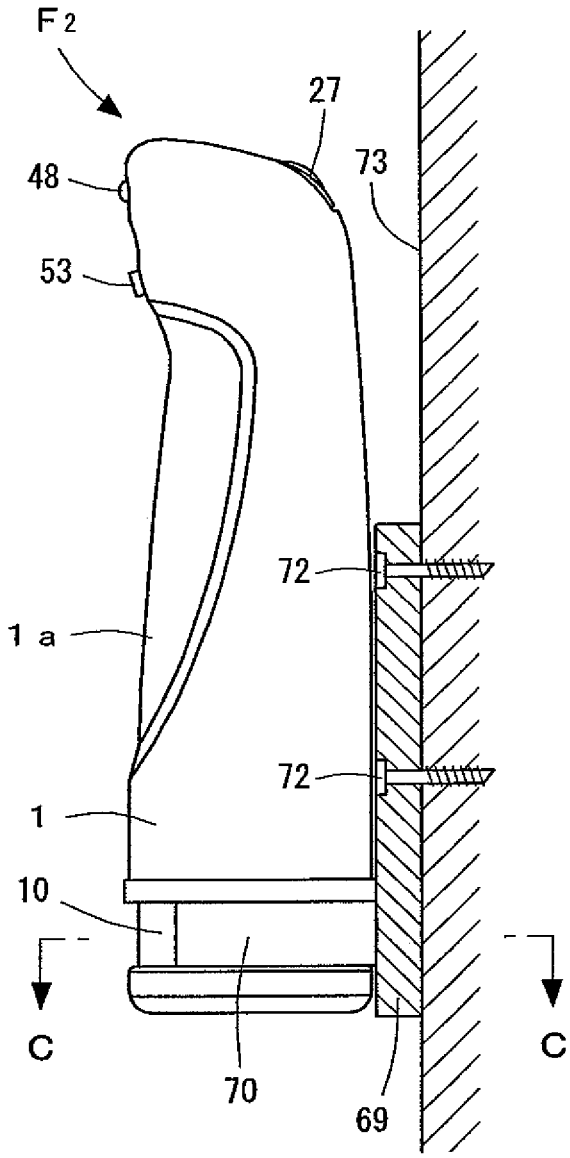
FIG. 18 is a sectional view of a third embodiment of this invention showing a state in which the jetting apparatus $F_2$ is mounted with an installation holder.
Figure 19:
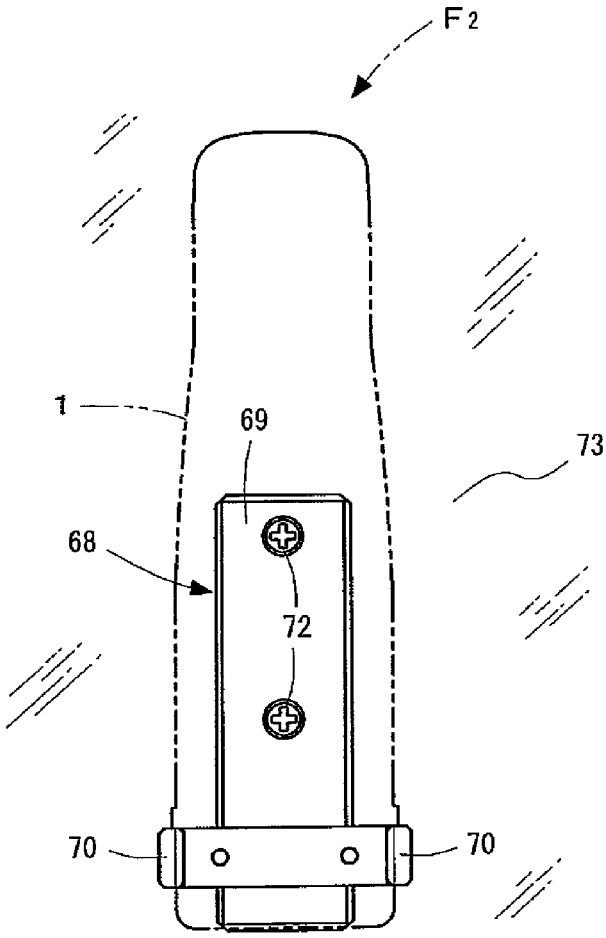
FIG. 19 is a front view of the installation holder applied to the third embodiment.
Figure 20:
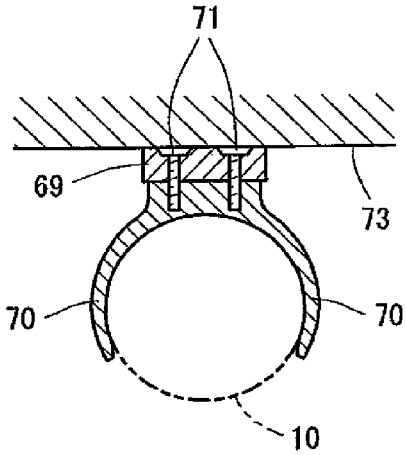
FIG. 20 is a sectional view taken along the line C-C of FIG. 18.

The third embodiment is shown in FIGS. 18 to 20. Here, an installation holder 68 that holds the jetting apparatus for fire extinguishing gas $F_2$ takes the place of the safety ring 55 because the installation holder 68 has ability to work like the safety ring 55. Therefore, the fourth embodiment prevents the gas cylinder 11 from being broken by mistake.

The installation holder 68 has a holder board 69 that is a lengthwise rectangle and made of synthetic resin, and a pair of clutching arms 70, 70. The clutching arms 70 and 70 are attached on a lower end of the holder board 69 by screws 71, and have suitable resilience.

Regarding the installation holder 68, the holder board 69 is attached on a desired position of a wall 73 in a building, inside or outside of a vehicle, etc. through screws 72 or double-faced tape. The bottom case 10 of the jetting apparatus for fire extinguishing gas $F_2$ is put between the clutching arms 70, 70 to be held between the clutching arms 70, 70 by resilience of the clutching arms 70, 70, and the jetting apparatus for fire extinguishing gas $F_2$ is held. Therefore, the bottom case 10 is prevented from moving upward and the gas cylinder 11 is previously prevented from being broken when the jetting apparatus for fire extinguishing gas $F_2$ is not used.

On the other hand, when the jetting apparatus for fire extinguishing gas $F_2$ is used, the jetting apparatus for fire extinguishing gas $F_2$ is pulled forward out of the clutching arms 70, 70 against pressure of the clutching arms 70, 70 so that the bottom case 10 can move upward. The bottom case 10 is pushed upward, and then the gas cylinder 11 can be broken.

Therefore, there is no need to perform complicated operation that the jetting apparatus for fire extinguishing gas $F_2$ is pulled out of the installation holder 68, and then the safety ring is pulled out. As a user perform the operation at once, and the user can quickly use the jetting apparatus for fire extinguishing gas $F_2$ early and extinguish a fire quickly.

Thus, the embodiment attaches the jetting apparatus for fire extinguishing gas $F_2$ on the installation holder 68, and can prevent the gas cylinder 11 from being broken by mistake.

Thus, in a jetting apparatus for fire extinguishing gas and a disaster warning system of the present invention, a sealing plate of a charged small gas cylinder is easily pierced, a valve prevents outflow of fire extinguishing gas and the gas waste, and attempts to use the fire extinguishing gas effectively and extinguish a fire are ordinarily effective. Further, the present invention provides for the jetting of gas to an origin of a fire surely and properly so that fire extinguishing is performed effectively, surely, and early. In addition, the present invention has an alarm apparatus that informs a person of a location of the fire extinguisher during fire emergency so that a person can use the fire extinguisher quickly and extinguish a fire at an early time. Thus, the present invention is suitable for a handy fire extinguisher and a disaster warning system, for example, in a house, an office, or a vehicle.

The invention claimed is:

1. In combination, a jetting apparatus for retaining and spraying a fire extinguishing gas and an emergency warning system, the combination comprising:

A) a jetting apparatus comprising:

a gas cylinder charged with pressurized fire extinguishing gas to which is attached a sealing plate on a mouth part thereof;

a case housing the gas cylinder, the case having an opening in communication with a passage;

a seal breaking member having a neb configured to break the sealing plate;

a cylinder holder positioned in the case above the gas cylinder provided with an opening for receiving the mouth part of the gas cylinder in a detachable arrangement, the cylinder holder having a guide hole that receives a seal breaking holder holding the seal breaking member therein;

the seal breaking member being biased to a side opposed from the sealing plate of the gas cylinder;

the passage including the guide hole in the cylinder holder and a conducting hole which is open to outside the jetting apparatus;

a control valve provided in the passage to block flow of fire extinguishing gas through the passage when the sealing plate is broken, the control valve operable by a control lever in engagement with a push rod that is in engagement with the control valve, the control valve being opened to permit discharge of the fire extinguishing gas when the control lever is actuated to a position corresponding to a control valve open position;

whereby, the fire extinguishing gas is discharged at high pressure through the passage to outside the jetting apparatus after seal breaking and actuation of the control lever to the control valve open position; and B) an emergency warning system comprising:

an accident alarm configured to output an alarm in response to receipt of a fire detection signal or a vibration detection signal of predetermined intensity; and an alarm apparatus which receives the alarm transmitted from the accident alarm and outputs a notification signal in the form of sound, voice, or light, the alarm apparatus attached to a front side of a top case part of the case that is adjacent the opening in the case;

a lamp positioned adjacent to the alarm apparatus on the top case part;

whereby the lamp turns on when the sealing plate is broken.

2. The combination of claim 1, further comprised of at least one of a fire detector for detecting the presence of heat or smoke or a vibration detector for detecting vibration of predetermined intensity, wherein the at least one of the fire detector or vibration detector transmit a signal to the accident alarm that is received thereby, and wherein in turn a signal is transmitted from the accident alarm and received by the alarm apparatus which outputs the notification signal, and wherein the accident alarm and the at least one of the fire detector or vibration detector are installed indoors.

3. The combination of claim 1, wherein the alarm apparatus is further comprised of a receiver configured to receive an alarm signal from the accident alarm, a microphone configured to collect the alarm signal, and one of a speaker, voice guide recorder, or an alarm lamp configured to output the notification signal with sound or voice or light.

4. The combination of claim 1, wherein the alarm apparatus is removably attached to the jetting apparatus.

5. The combination of claim 1, wherein the alarm apparatus is removably attached to the jetting apparatus by any one of a string, a belt, a pin, a snap, a hook, a hook and loop fastener, and a button.

6. The combination of claim 1, wherein the alarm apparatus is configured to be portable.

7. A disaster warning system including a jetting apparatus for fire extinguishing gas and an disaster notifying component, the system comprising:

A) a jetting apparatus comprising:

a gas cylinder charged with pressurized fire extinguishing gas to which is attached a sealing plate on a mouth part thereof;

a case housing the gas cylinder, the case having an opening in communication with a passage;

a seal breaking member having a neb configured to break the sealing plate;

a cylinder holder positioned in the case above the gas cylinder provided with an opening for receiving the mouth part of the gas cylinder in a detachable arrangement, the cylinder holder having a guide hole that receives a seal breaking holder holding the seal breaking member therein;

the seal breaking member being biased to a side opposed from the sealing plate of the gas cylinder;

the passage including the guide hole in the cylinder holder and a conducting hole which is open to outside the jetting apparatus;

a control valve provided in the passage to block flow of fire extinguishing gas through the passage when the sealing plate is broken, the control valve operable by a control lever in engagement with a push rod that is in engagement with the control valve, the control valve being opened to permit discharge of the fire extinguishing gas when the control lever is actuated to a position corresponding to a control valve open position;

whereby the fire extinguishing gas is discharged through the passage to outside the jetting apparatus after seal breaking and actuation of the control lever to the control valve open position; and B) the disaster notifying component comprising:

an accident alarm configured to output an alarm signal in response to receipt of a fire detection signal or a vibration detection signal of predetermined intensity and which accident alarm is installed indoors; and wherein the jetting apparatus for fire extinguishing gas is provided with an alarm apparatus configured to receive the alarm and output a notification signal in the form of voice, sound, or light, the alarm apparatus being attached to a front side of a top case part of the case;

a lamp positioned adjacent to the alarm apparatus on the top case part;

whereby the lamp turns on when the sealing plate is broken, allowing identification of the location of the jetting apparatus when a fire or a predetermined vibration is detected with the outputting of the notification signal.

8. The disaster warning system according to claim 7, further comprised of a plurality of jetting apparatuses for fire extinguishing gas, which plurality of jetting apparatuses are installed in an area within range of an alarm signal transmitted by the accident alarm so that the alarm signal from the accident alarm is received by each of an alarm apparatus that are removably attached to each one in the plurality of jetting apparatuses.

9. The disaster warning system according to claim 7, wherein the alarm apparatus is comprised of a receiver configured to receive the alarm signal from the accident alarm, and one of a speaker, a voice guide recorder, or an alarm lamp, wherein the one of the speaker, voice guide recorder, or alarm lamp is configured to operate when the receiver receives the signal.

10. A disaster warning system according to claim 7, wherein the system is configured so that a signal transmitted from a fire detector which senses heat or smoke or a signal from a vibration detector which senses a predetermined earthquake intensity scale is to be inputted into the accident alarm.

11. The disaster warning system according to claim 7, wherein the alarm apparatus is removably attached to the jetting apparatus for fire extinguishing gas.

12. The disaster warning system according to claim 7, wherein the alarm apparatus is removably attached to the jetting apparatus by one of a string, a belt, a pin, a snap, a hook, a hook and loop fastener, and a button.

13. The disaster warning system according to claim 7, wherein the alarm apparatus is configured to be worn by a person.

14. The disaster warning system according to claim 7, wherein the alarm apparatus is configured to be portable.

* * * * *